US007614269B2

(12) United States Patent
Honda et al.

(10) Patent No.: US 7,614,269 B2
(45) Date of Patent: Nov. 10, 2009

(54) METHOD AND DEVICE FOR MACHINING FLANGE PART OF WHEEL ARCH

(75) Inventors: Noriyuki Honda, Utsunomiya (JP); Tsutomu Yokota, Sayama (JP); Yoshihiro Kageyama, Utsunomiya (JP); Keishi Okunaka, Utsunomiya (JP); Tadashi Tobita, Utsunomiya (JP); Satoru Matsuo, Ontario (CA); Akira Kodama, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 658 days.

(21) Appl. No.: 10/568,660

(22) PCT Filed: Aug. 18, 2004

(86) PCT No.: PCT/JP2004/011844

§ 371 (c)(1),
(2), (4) Date: Feb. 16, 2006

(87) PCT Pub. No.: WO2005/016568

PCT Pub. Date: Feb. 24, 2005

(65) Prior Publication Data

US 2006/0218986 A1 Oct. 5, 2006

(30) Foreign Application Priority Data

Aug. 19, 2003 (JP) ..... 2003-207859
Nov. 13, 2003 (JP) ..... 2003-383775

(51) Int. Cl.
*B21D 5/16* (2006.01)
*B21D 39/02* (2006.01)

(52) U.S. Cl. ..... 72/17.3; 72/319; 72/446; 29/243.58

(58) Field of Classification Search ..... 72/17.3, 72/220, 306, 319, 403, 446; 29/243.58
See application file for complete search history.

(56) References Cited

U.S. PATENT DOCUMENTS

| | | | | |
|---|---|---|---|---|
| 5,228,190 | A * | 7/1993 | Sawa | 72/220 |
| 5,272,903 | A * | 12/1993 | Evans | 72/403 |
| 6,324,880 | B1 * | 12/2001 | Nakamura | 72/17.3 |
| 6,849,820 | B2 * | 2/2005 | Nakamura | 72/306 |
| 6,983,633 | B2 * | 1/2006 | Holmgren et al. | 72/220 |

FOREIGN PATENT DOCUMENTS

| | | |
|---|---|---|
| GB | 2 305 695 | 4/1997 |
| JP | 07-047429 | 2/1995 |
| JP | 9-108743 | 4/1997 |
| JP | 2000-061557 | 2/2000 |
| JP | 2000-312935 | 11/2000 |
| JP | 2001-198629 | 7/2001 |
| JP | 2004-105991 | 4/2004 |

* cited by examiner

*Primary Examiner*—David B Jones
(74) *Attorney, Agent, or Firm*—Rankin, Hill & Clark LLP

(57) ABSTRACT

A device for machining the flange part of a wheel arch, wherein a machining mechanism includes, as general-purpose drive parts, first to third cylinders, and the work bending mold for bending the flange part of the wheel arch, work receiving mold, and work guide of the machining mechanism are replaceable with those of the other types. When a dedicated mold is replaced according to the shape of a work, the entire part of the machining mechanism must not be replaced, but merely the work bending mold, work receiving mold and work guide may be replaced with those of the other types.

15 Claims, 21 Drawing Sheets

METHOD AND DEVICE FOR MACHINING FLANGE PART OF WHEEL ARCH

TECHNICAL FIELD

The present invention relates to a method of and an apparatus for machining a flange of a wheel arch of an automobile body by bending the flange.

BACKGROUND ART

As shown in FIG. 19, for example, it is desirable to reduce the gap between a wheel arch 2 of an automobile vehicle body 1 and a tire 3, and to keep a space in a wheel house. To meet these demands, as shown FIG. 20, it has been the practice in the art to bend a flange 5 comprising a welded joint of an inner panel 4*a* and an outer panel 4*b* of the vehicle body 1, into the vehicle body 1.

According to a hem machining apparatus disclosed in Patent Document 1, for example, as shown in FIG. 21, a workpiece W in the form of an automobile body side is conveyed along a production line 6, and hem dies 7*a* through 7*f*, three in each of two locations, corresponding to various body sides are disposed on one side of the production line 6. A die feed robot 8 is disposed between the hem dies 7*a* through 7*c* and the hem dies 7*d* through 7*f*. The die feed robot 8 selectively holds either one of the hem dies 7*a* through 7*f* for the workpiece W, and machines the workpiece W with the selected hem die.

As shown in FIG. 22, the hem die 7*a*, for example, is removably held by a hand changer 10 on the distal end of a wrist 9 of the die feed robot 8. The hem die 7*a* has a pair of holding brackets 11 with a workpiece holder 12 on upper portions thereof. A prebending tool 13 is angularly movably supported by a support shaft 14 in the vicinity of the workpiece holder 12. The prebending tool 13 has a tip end for prebending a flange F of the workpiece W.

A bending tool 15 is angularly movably mounted on the holding brackets 11 by a support shaft 16. The bending tool 15 and the prebending tool 13 are coupled to each other by a joint 17. An actuating cylinder 19 is angularly movably supported on the holding brackets 11 by a support shaft 18, and has a piston rod 19*a* having a distal end on which the bending tool 15 is angularly movably supported.

As shown in FIG. 23A, an apparatus 120 for bending a wheel house as disclosed in Patent Document 2 has a workpiece holder 122 mounted on a frame 121 and a workpiece pusher 124 and a workpiece bender 123 which are slidably mounted on the frame 121.

The workpiece holder 122 is set on an inner corner of a flange 126 of a wheel arch 125. As shown in FIG. 23B, the workpiece pusher 124 is slid in the direction indicated by the arrow 1, and pushes the flange 126 against the workpiece holder 122. Then, as shown in FIG. 23C, the workpiece bender 123 is slid in the direction indicated by the arrow 2 until it abuts against the flange 126. As shown in FIG. 23D, the workpiece bender 123 is further slid in the direction indicated by the arrow 3, bending the flange 126.

Patent Document 1: Japanese Laid-Open Patent Publication No. 2000-312935

Patent Document 2: Japanese Laid-Open Patent Publication No. 9-108743

DISCLOSURE OF THE INVENTION

Problems to be Solved by the Invention

According to Patent Document 1, however, the actuating cylinder 19 is provided in each of the hem dies 7*a* through 7*f* (see FIG. 22). Therefore, each of the hem dies 7*a* through 7*f* is complex in structure and large in size, and the manufacturing cost thereof is high.

Furthermore, since the die feed robot 8 selectively holds the hem dies 7*a* through 7*f*, the hem dies 7*a* through 7*f* need to be disposed in a movable range of the die feed robot 8 (see FIG. 21). Consequently, a space is required around the die feed robot 8 for placing the hem dies 7*a* through 7*f* therein, and the number of hem dies placed in the movable range of the die feed robot 8 is limited. As the hem dies 7*a* through 7*c* and the hem dies 7*d* through 7*f* are disposed on both sides of the die feed robot 8, the freedom of the movable range of the die feed robot 8 is restricted.

According to the bending apparatus 120 disclosed in Patent Document 2, when the bending apparatus 120 is set in the wheel arch 125 by a robot, the set position of the wheel arch 125 itself tends to vary or the bending apparatus 120 is liable to be set differently due to the degree of accuracy of the robot. Therefore, the wheel arch 125 and the bending apparatus 120 are likely to be positionally displaced in the directions indicated by the blank arrow in FIG. 23A. Particularly, the wheel arch 125 itself suffers large positional variations.

Consequently, the wheel arch 125 cannot be bent accurately, and may be deformed in certain cases.

If the set position of the wheel arch 125 itself is to be improved or the accuracy of the robot is to be improved, then not only highly sophisticated control technology is required, but also devices for setting the bending apparatus 120 and the wheel arch 125 are complicated in structure and become highly costly to manufacture.

The present invention has been made to solve the above problems. It is an object of the present invention to provide a method of and an apparatus for machining a flange of a wheel arch through a simple and compact arrangement, in a working range of high freedom with excellent general versatility for efficient bending operation.

Another object of the present invention is to provide a method of and an apparatus for machining a flange of a wheel arch, which can easily be set in the wheel arch and can accurately bend the flange of the wheel arch.

Means for Solving the Problems

In a method of and an apparatus for machining a flange of a wheel arch according to the present invention, a general-purpose actuator is conveyed to a machining position for the flange by a moving mechanism while a dedicated die is being mounted on the general-purpose actuator provided on the moving mechanism. The general-purpose actuator is actuated to bring the dedicated die into abutment against the flange and cause the dedicated die to bend the flange.

Preferably, flanges of respective wheel arches on both sides of the vehicle body can be bent substantially simultaneously when at least a pair of the moving mechanisms disposed respectively on both sides of the vehicle body is actuated.

Preferably, the dedicated die is selected depending on the shape of the flange and the selected dedicated die is removably mounted on the general-purpose actuator.

Preferably, a machining station for bending the flange is included in a machining station for performing a machining process different from a bending process.

According to the present invention, a workpiece guide means is set in a predetermined position with a predetermined clearance provided on an outer surface of the flange of the wheel arch and a workpiece rest means is set in a predetermined position with a predetermined clearance provided on an inner surface of the flange of the wheel arch. The workpiece guide means and the workpiece rest means are moved closely to each other to dispose the workpiece guide means on the outer surface of the flange and to dispose the workpiece rest means on the inner surface of the flange.

According to the present invention, furthermore, a first slide means is slidably mounted on a base and a workpiece guide means is slidably mounted on the first slide means, and a second slide means is slidably mounted on the base and a workpiece rest means and a workpiece bending means is mounted on the second slide means. A mutual distance changing means is interposed between the first and second slide means for moving the first and second slide means toward and away from each other.

For setting the workpiece guide means and the workpiece rest means on the wheel arch of a side panel, the first and second slide means are spaced from each other by the mutual distance changing means, providing a clearance on an outer surface of the flange to allow the workpiece guide means to be set in place. A clearance is provided from an inner surface of the flange to allow the workpiece rest means to be set in place, and the first and second slide means are brought toward each other by the mutual distance changing means until the workpiece guide means is held against the outer surface of the flange and the workpiece rest means is held against the inner surface of the flange.

Preferably, a nonmetallic pad is disposed in a workpiece abutment region of the workpiece guide means.

Advantageous Effects of the Invention

According to the present invention, since the general-purpose actuator is provided in the moving mechanism, dedicated components can be set as dedicated dies. It is not necessary to provide various machining mechanisms with actuators around the moving mechanism. Therefore, the degree of freedom of the operating range is large, and the apparatus can be trained and serviced for maintenance with efficiency.

As the moving mechanisms are disposed on both sides of the vehicle body, the flanges of the left and right wheel arches of the vehicle body can simultaneously be bent. The cycle time of the apparatus is thus made shorter than if the flanges are machined one at a time, resulting in efficient machining operation.

Inasmuch as dedicated components are removably mounted on the general-purpose actuator, only the dedicated components that are relatively light in weight and small in size may be replaced. The process of replacing the dedicated components is simplified for easily increasing the operating efficiency. Only a plurality of dedicated components need to be prepared, and they can be stacked vertically. Consequently, the space for stocking the dedicated components is greatly reduced, and a relatively large space is available for replacing the dedicated components.

Because the machining station is included in a machining station for performing a machining process different from a bending process, a robot that is used in a welding process, a sealing process, a mechanical fastening process such as a crimping process, or the like can be used as a machining apparatus in the machining method. As a welding mechanism (welding gun) and a machining mechanism may only be exchanged, the robot can easily be made versatile economically.

According to the present invention, moreover, a variation of the set position of the wheel arch with respect to the workpiece guide means and the workpiece rest means can be absorbed. As a result, the bending of the wheel arch is facilitated, and the time required to bend the wheel arch is shortened.

The machining apparatus can easily be set on the wheel arch, and after the machining apparatus has been set, the mutual distance changing means moves the first and second slide means toward each other for bending the flange of the wheel arch accurately. As a consequence, the time required to bend the wheel arch is shortened, and the quality of the bent wheel arch is increased.

The nonmetallic pad disposed in the workpiece abutment region of the workpiece guide means serves to protect and guide the side panel. Therefore, when the side panel is bent, the side panel is prevented from being damaged.

BEST MODE FOR CARRYING OUT THE INVENTION

Figure 1:
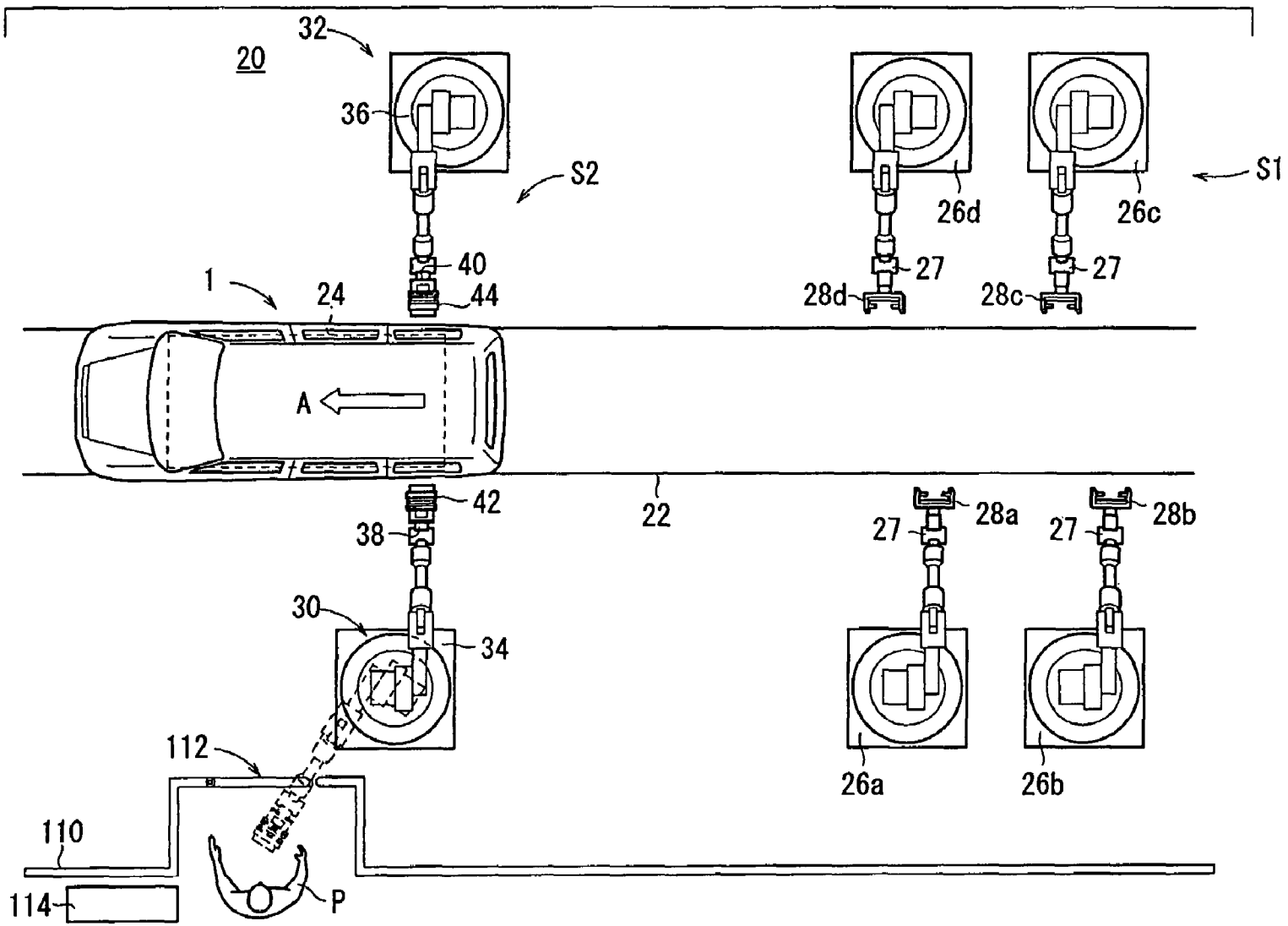
FIG. 1 is a schematic view of a production system for carrying out a method of machining a flange of a wheel arch according to an embodiment of the present invention.

FIG. 1 is a schematic view of a production system 20 for carrying out a method of machining a flange of a wheel arch according to an embodiment of the present invention.

The production system 20 has a production line 22 extending in the direction indicated by the arrow A. A work platform 24 with a vehicle body 1 placed thereon is conveyed along the production line 22. Various working stations are disposed along the production line 22. For example, a machining station S2 is disposed downstream of and adjacent to a welding station S1. The machining station S2 may be included in a machining station for performing a machining process different from a flange bending process according to the embodiment. For example, the machining station S2 may function as a spot welding station included in the welding station S1.

The welding station S1 has a plurality of articulated robots 26*a* through 26*d* for welding operation, disposed on both sides of, e.g., two on each side of, the production line 22. The articulated robots 26*a* through 26*d* have welding guns (welding mechanisms) 28*a* through 28*d* removably mounted on respective wrists 27.

Figure 2:
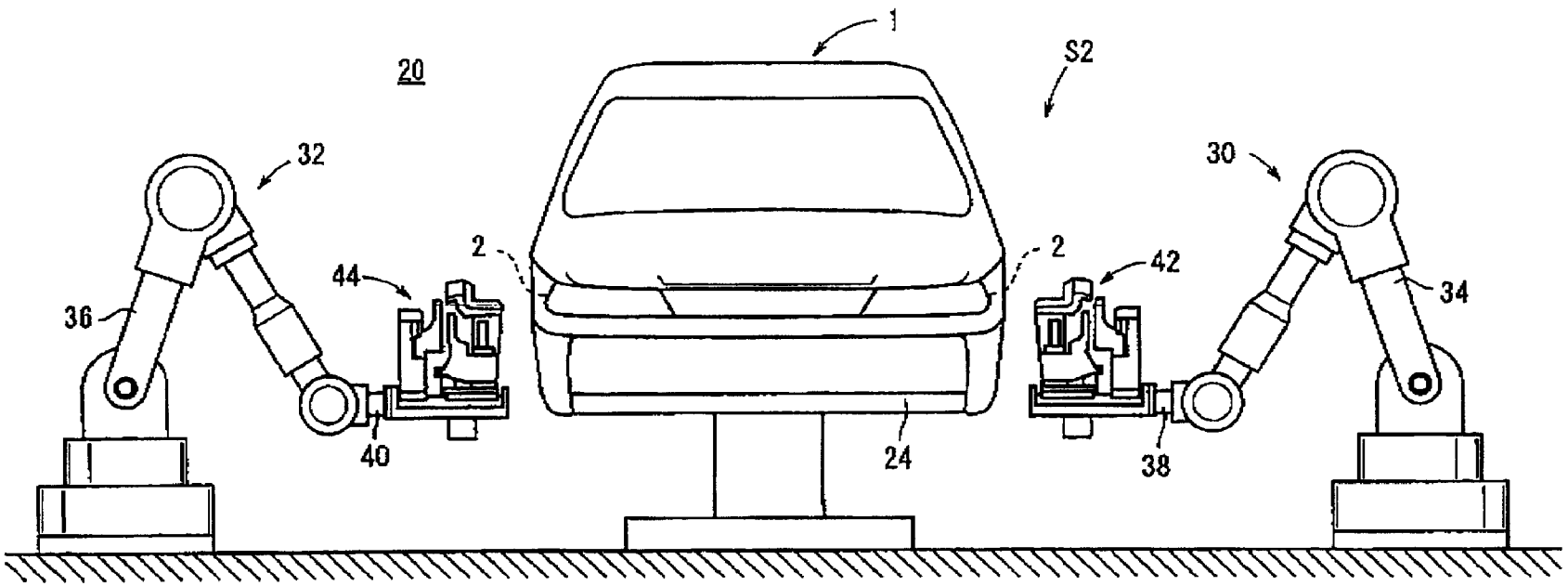
FIG. 2 is a front elevational view of a machining apparatus of the production system.
Figure 3:
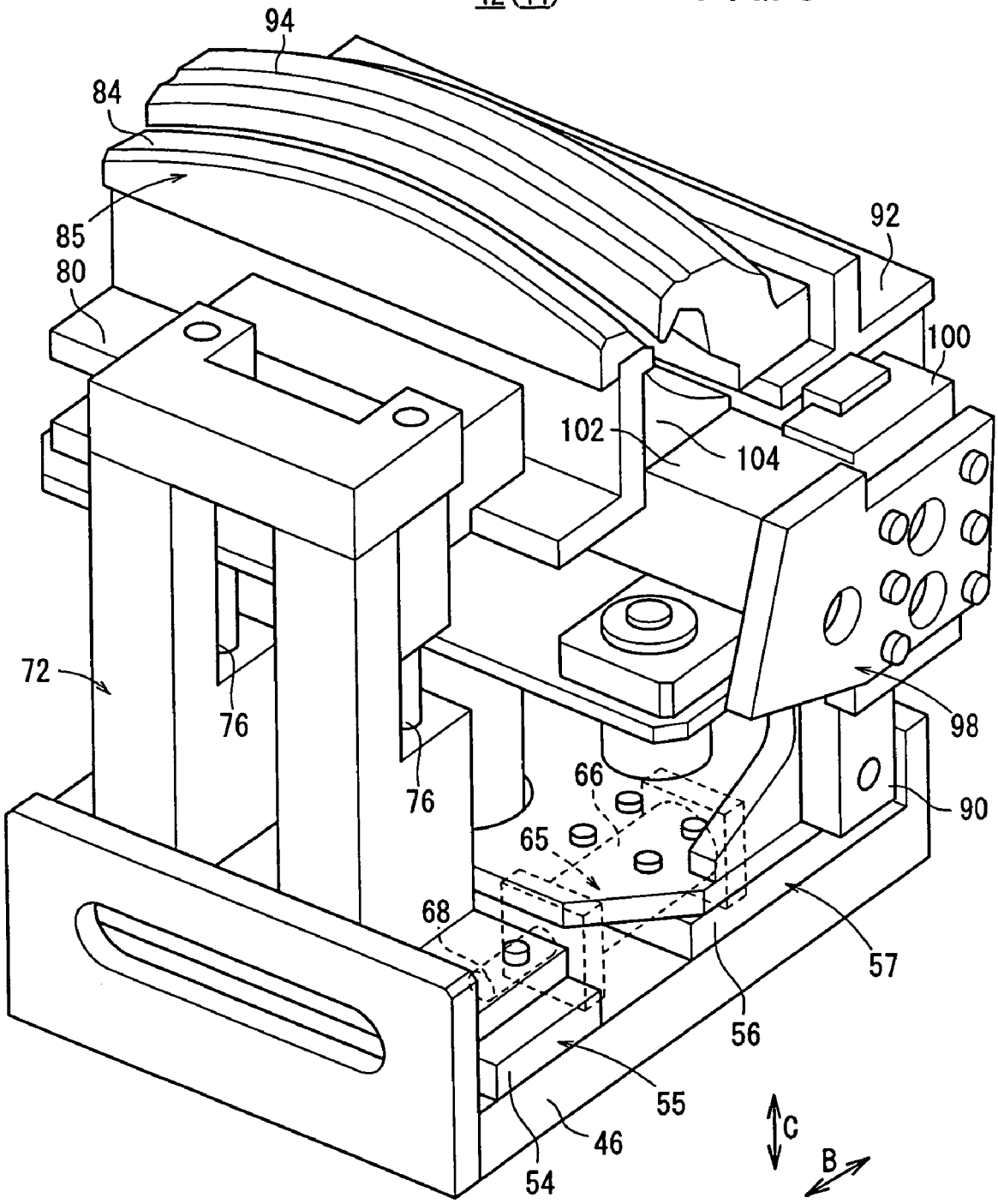
FIG. 3 is a perspective view of a machining mechanism of the machining apparatus.

The machining station S2 has machining apparatus 30, 32 according to the embodiment, one on each side of the production line 22. As shown in FIGS. 1 and 2, the machining apparatus 30, 32 have working robots, e.g., articulated robots (moving mechanisms) 34, 36. Machining mechanisms 42, 44 are replaceably mounted on respective wrists 38, 40 of the articulated robots 34, 36 by automatic tool changers (ATC), not shown.

The machining mechanism 42 will be described in detail below. The machining mechanism 44 will not be described in detail below as it is identical in structure to the machining mechanism 42.

As shown in FIGS. 3 through 6, the machining mechanism 42 has a base 46 mounted on the wrist 38 of the articulated robot 34. The base 46 supports two rails 48 disposed thereon which extend in the direction indicated by the arrow B, and has an opening 50 and a relief hole 52 (see FIG. 4) defined therein between the rails 48. The rails 48 are mounted on the base 46 by rail support members 53 which have stops 53*a* against which a first slide means 55 or a second slide means 57 is held.

Figure 4:
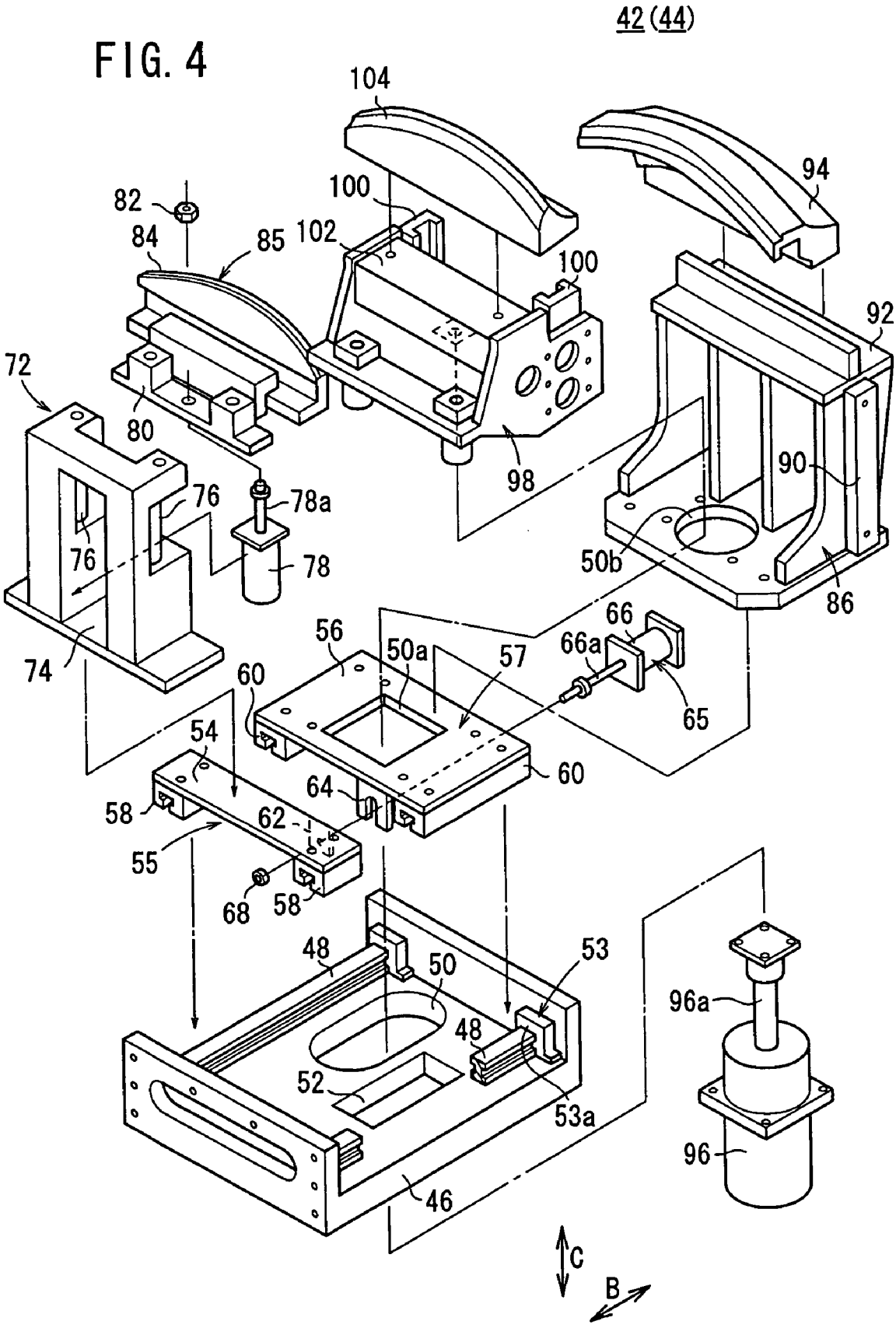
FIG. 4 is an exploded perspective view of the machining mechanism.
Figure 5:
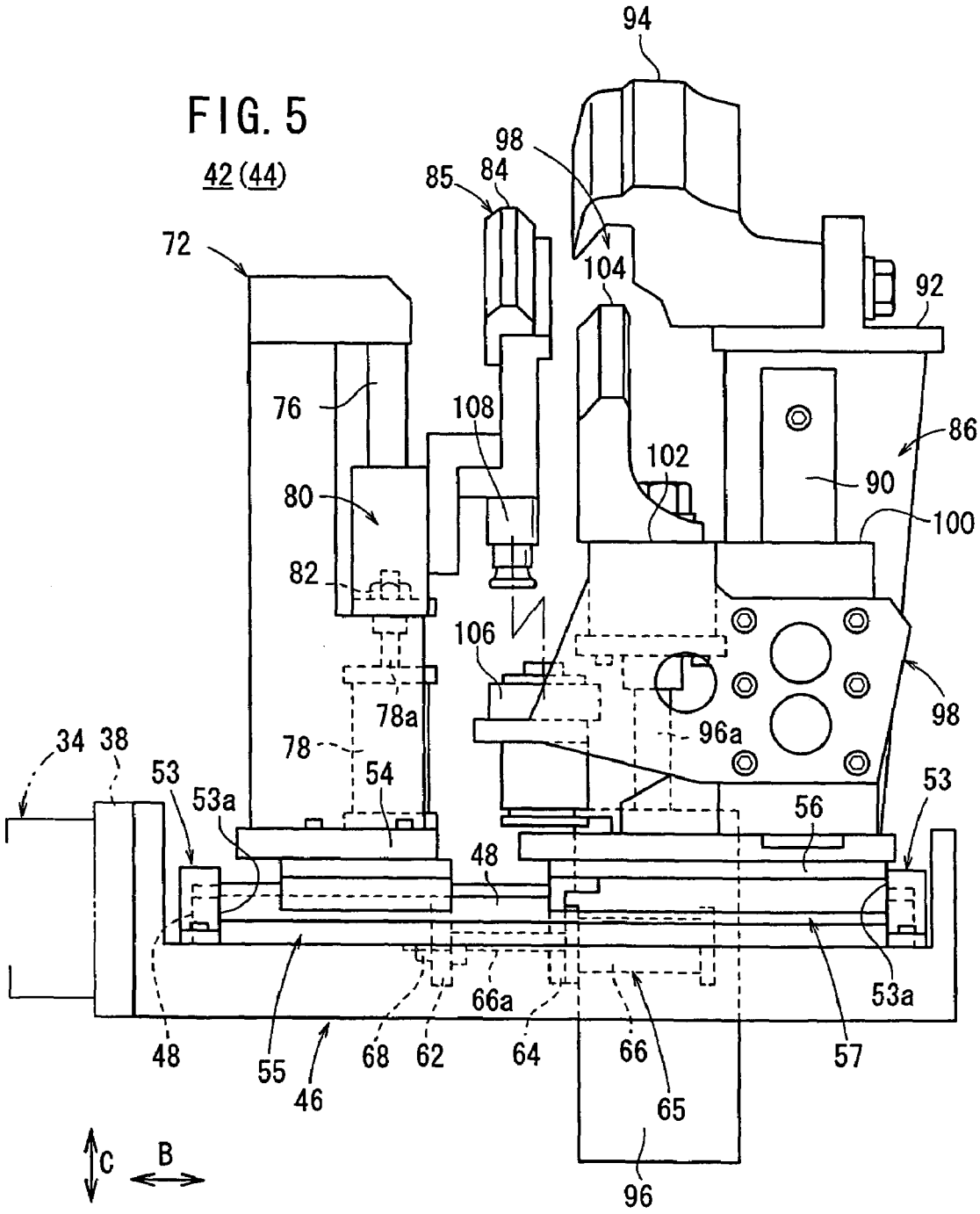
FIG. 5 is a side elevational view of the machining mechanism.
Figure 6:
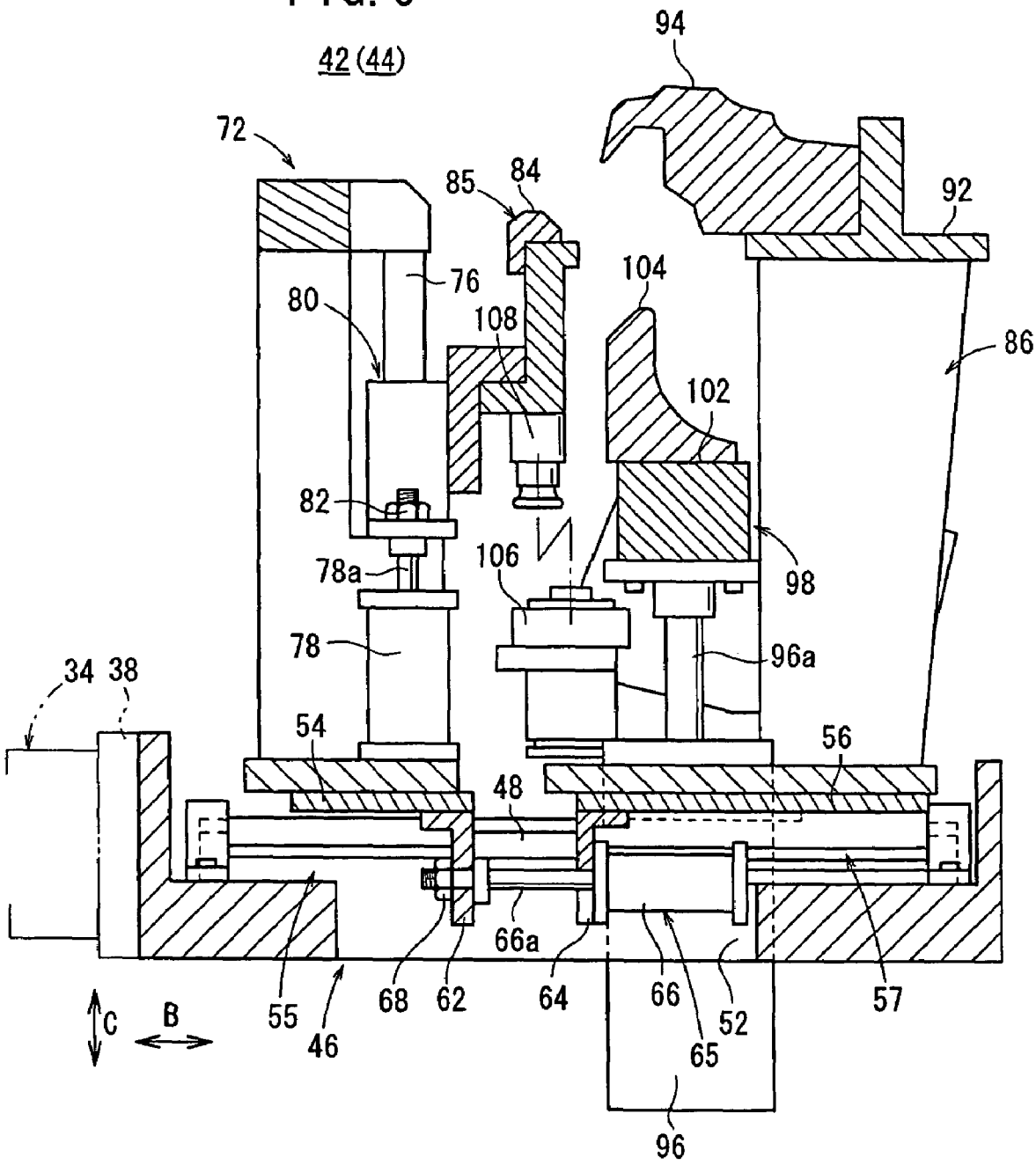
FIG. 6 is a view, partly in cross section, of the machining mechanism.

As shown in FIGS. 4 through 6, the first slide means 55 and the second slide means 57 have respective first and second slide bases 54, 56 placed on the rails 48. A pair of rail guides 58, 60 engaging the pair of left and right rails 48 is fixed to the first and second slide bases 54, 56, respectively. Downwardly projecting brackets 62, 64 are also fixed to the first and second slide bases 54, 56, respectively.

A first cylinder (general-purpose actuator) 66 of a mutual distance changing means 65 is mounted on the bracket 64 of the second slide base 56. The first cylinder 66 has a rod 66*a* extending in the direction indicated by the arrow B and inserted in the bracket 62 of the first slide base 54. The rod 66*a* is fastened to the bracket 62 by a nut 68 threaded over the distal end thereof. The first cylinder 66 is accommodated in the relief hole 52 in the base 46 (see FIG. 5). The mutual distance changing means 65 moves the first and second slide means 55, 57 toward and away from each other.

A workpiece guide frame 72 is mounted on the first slide base 54. The workpiece guide frame 72 has a central recess defined therein as an accommodating space 74 with guide posts 76 disposed on both sides thereof. A second cylinder (general-purpose actuator) 78 is disposed in the accommodating space 74. The second cylinder 78 has a rod 78*a* extending upwardly (in the direction indicated by the arrow C) through an attachment member 80. The rod 78*a* is fastened to the attachment member 80 by a nut 82 threaded over the distal end thereof. A workpiece guide (workpiece guide means) 85 having a nonmetallic pad 84 for abutment against a wheel arch 2 of the vehicle body 1 is fixedly mounted on the attachment member 80.

The nonmetallic pad 84 is made of nylon, urethane, or hard rubber. If the material of the nonmetallic pad 84 is too soft, it does not produce a sufficient pressing force for pressing a flange 5. If the material of the workpiece guide 85 is too hard, it may possibly damage or deform a side panel of the vehicle body 1. The nonmetallic pad 84 of the workpiece guide 85 serves to protect and guide an outer panel 4*b* of the side panel. As a result, the flange 5 can be bent without damaging or deforming the side panel.

The second slide base 56 has an opening 50*a* defined therein, and a workpiece rest frame 86 is mounted on the second slide base 56. The workpiece rest frame 86 has an opening 50*b* defined in the bottom thereof. A pair of guide rails 90 extending in the direction indicated by the arrow C is mounted on respective opposite sides of the workpiece rest frame 86.

A clamp 92 is disposed on an upper portion of the workpiece rest frame 86. A workpiece rest die (dedicated die) 94 as a workpiece rest means is replaceably mounted on the clamp 92 by bolts (not shown). A third cylinder (general-purpose actuator) 96 is fixed to the bottom of the workpiece rest frame 86. The third cylinder 96 is inserted in the openings 50, 50*a*, 50*b* and has a rod 96*a* extending vertically upwardly and fixed to a workpiece lifting and lowering body 98.

Guides 100 engaging the respective guide rails 90 of the workpiece rest frame 86 are fixed to the workpiece lifting and lowering body 98 in confronting relation to each other. A clamp 102 is disposed on an upper portion of the workpiece lifting and lowering body 98. A workpiece bending die (dedicated die) 104 as a workpiece bending means is replaceably mounted on the clamp 102 by bolts (not shown).

As shown in FIGS. 5 and 6, a gas cushion 106 is mounted on the workpiece rest frame 86, and a gas cushion bearing 108 for bearing the gas cushion 106 is fixed to the attachment member 80.

As shown in FIG. 1, a dedicated die replacing section 112 is disposed in a position remote from the machining station S2, e.g., outside of a fence 110 (or outside of an operating range of the articulated robot 34). Various dedicated dies 114 can be stocked at the dedicated die replacing section 112.

Operation of the production system 20 thus constructed will be described below in reference to a flange machining method according to a first embodiment.

The vehicle body 1 as a white body has been mounted on the work platform 24. When the work platform 24 is conveyed in the direction indicated by the arrow A (see FIG. 1), the vehicle body 1 is placed in the welding station S1. In the welding station S1, the vehicle body 1 is spot-welded by the welding guns 28*a* through 28*d* mounted on the respective articulated robots 26*a* through 26*d*.

The spot-welded vehicle body 1 is conveyed by the work platform 24 into the machining station S2 and stops at a given position in the machining station S2. In the machining station S2, the machining apparatus 30, 32 are actuated. Only operation of the machining apparatus 30 will be described below.

Figure 7:
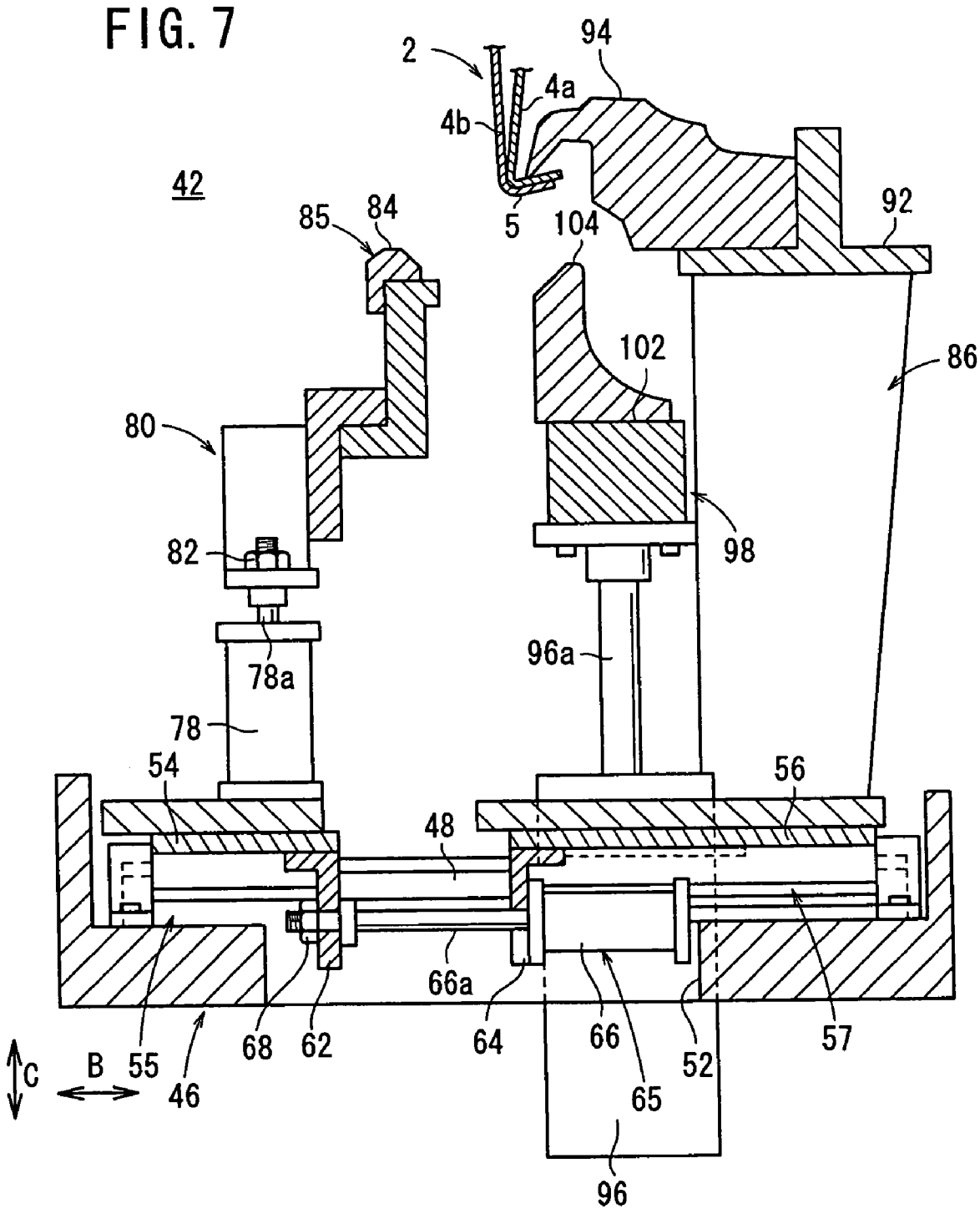
FIG. 7 is a view of the machining mechanism as disposed with respect to a wheel arch in a machining method according to a first embodiment.

The articulated robot 34 of the machining apparatus 30 is actuated based on a teaching operation for the position of the flange 5. The machining mechanism 42 mounted on the wrist 38 moves toward the wheel arch 2 on one side of the vehicle body 1, and is positioned and stopped in alignment with a machining position on the wheel arch 2 (see FIG. 7). Of the wheel arch 2, the inner panel 4*a* and the outer panel 4*b* have been joined to each other by spot welding, and an inner side of the flange 5 (the inner panel 4*a*) is supported by the workpiece rest die 94.

Figure 8:
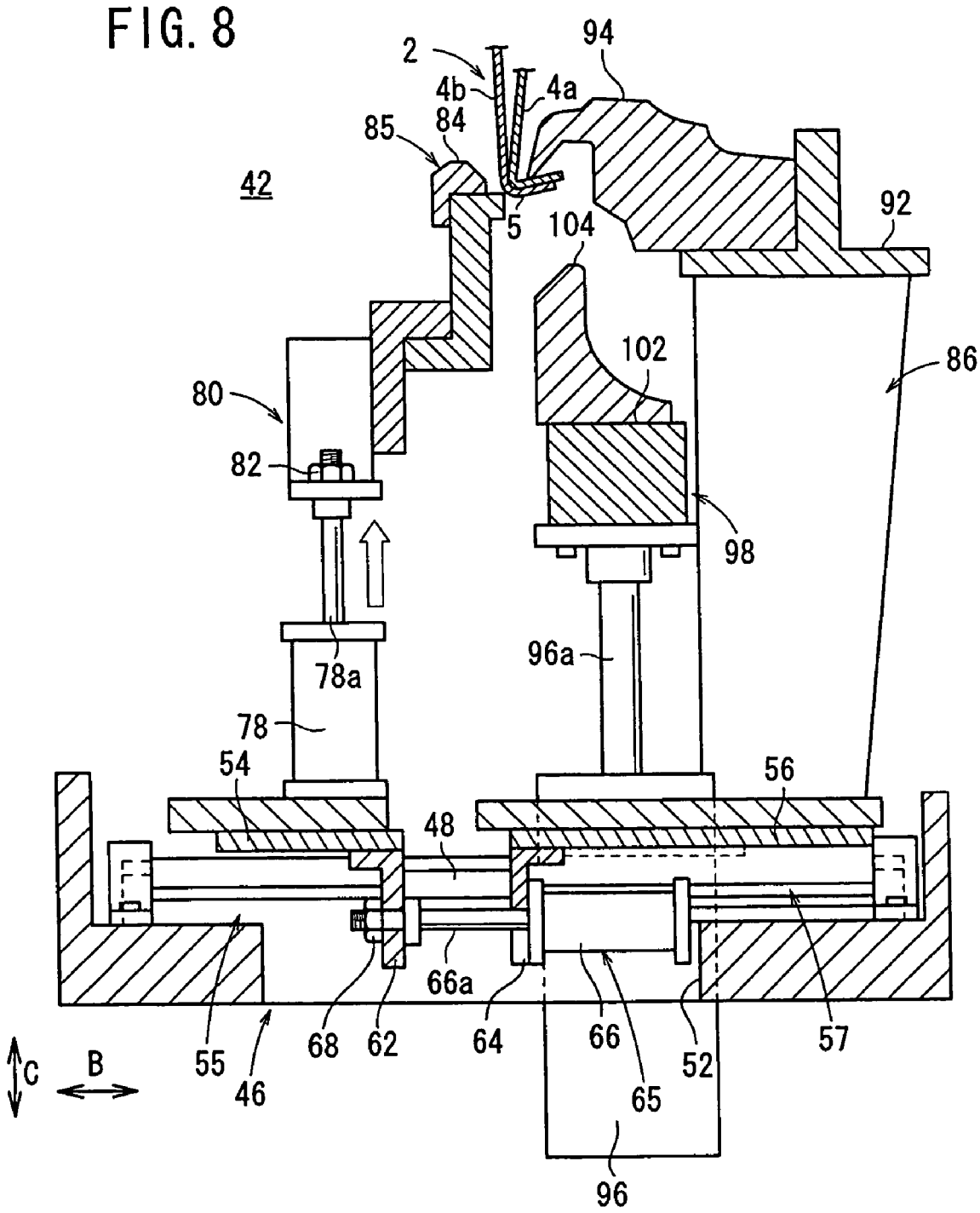
FIG. 8 is a view showing the machining mechanism with a workpiece guide lifted.

Then, as shown in FIG. 8, the second cylinder 78 is actuated to displace the rod 78*a* upwardly. Therefore, the workpiece guide 85 with the nonmetallic pad 84 is brought to a predetermined height in unison with the attachment member 80 that is fixed to the rod 78*a*.

Figure 9:
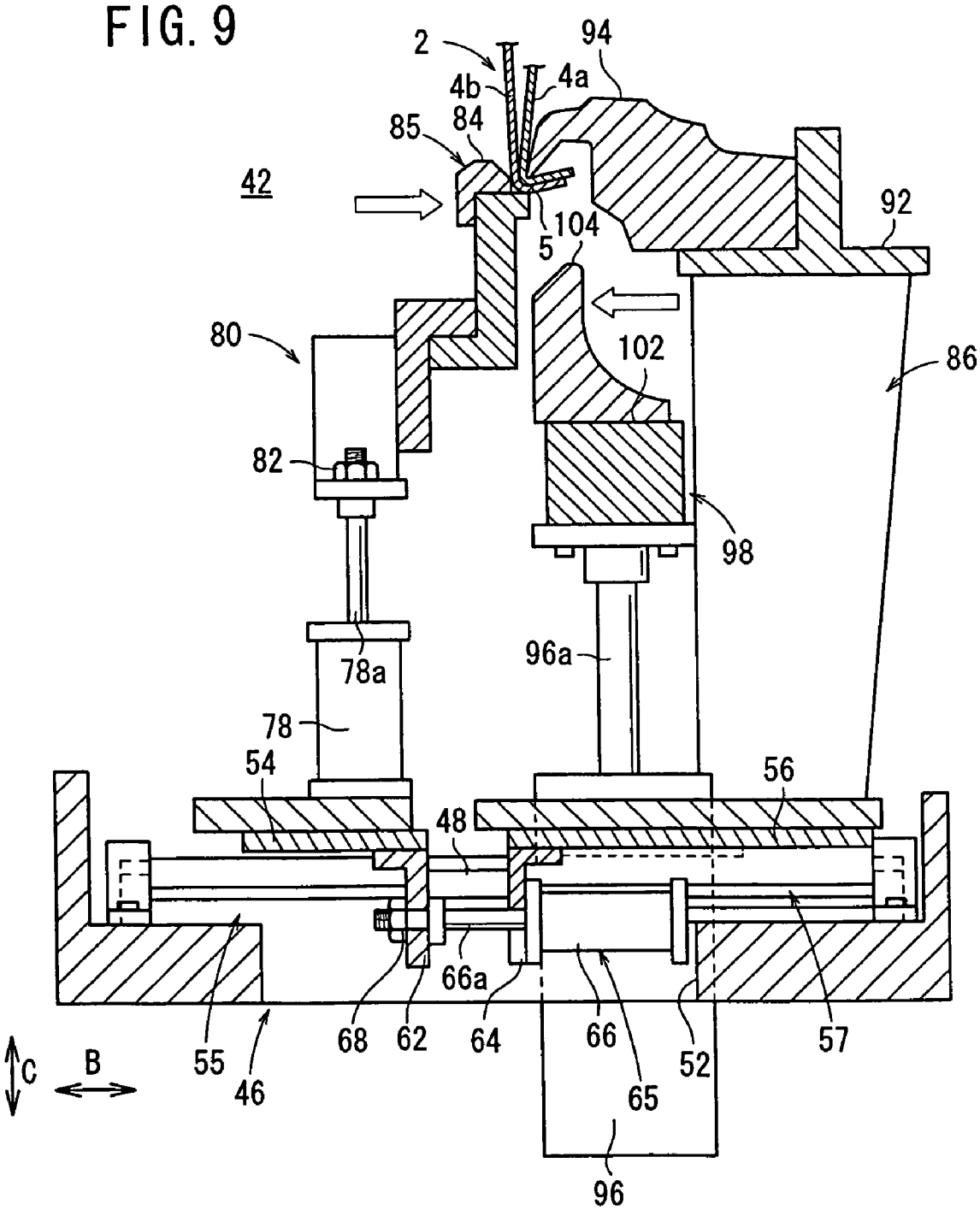
FIG. 9 is a view showing the manner in which the workpiece guide and a workpiece bending die are centered.

The first cylinder 66 is actuated to displace the rod 66*a* inwardly. The first and second slide bases 54, 56 are displaced toward each other, centering the workpiece guide 85 and the workpiece bending die 104, and bringing the workpiece guide 85 against an outer side of the wheel arch 2 (the outer panel 4*b*) (see FIG. 9). The flange of the wheel arch 2 is now held by the workpiece guide 85 and the workpiece rest die 94.

Figure 10:
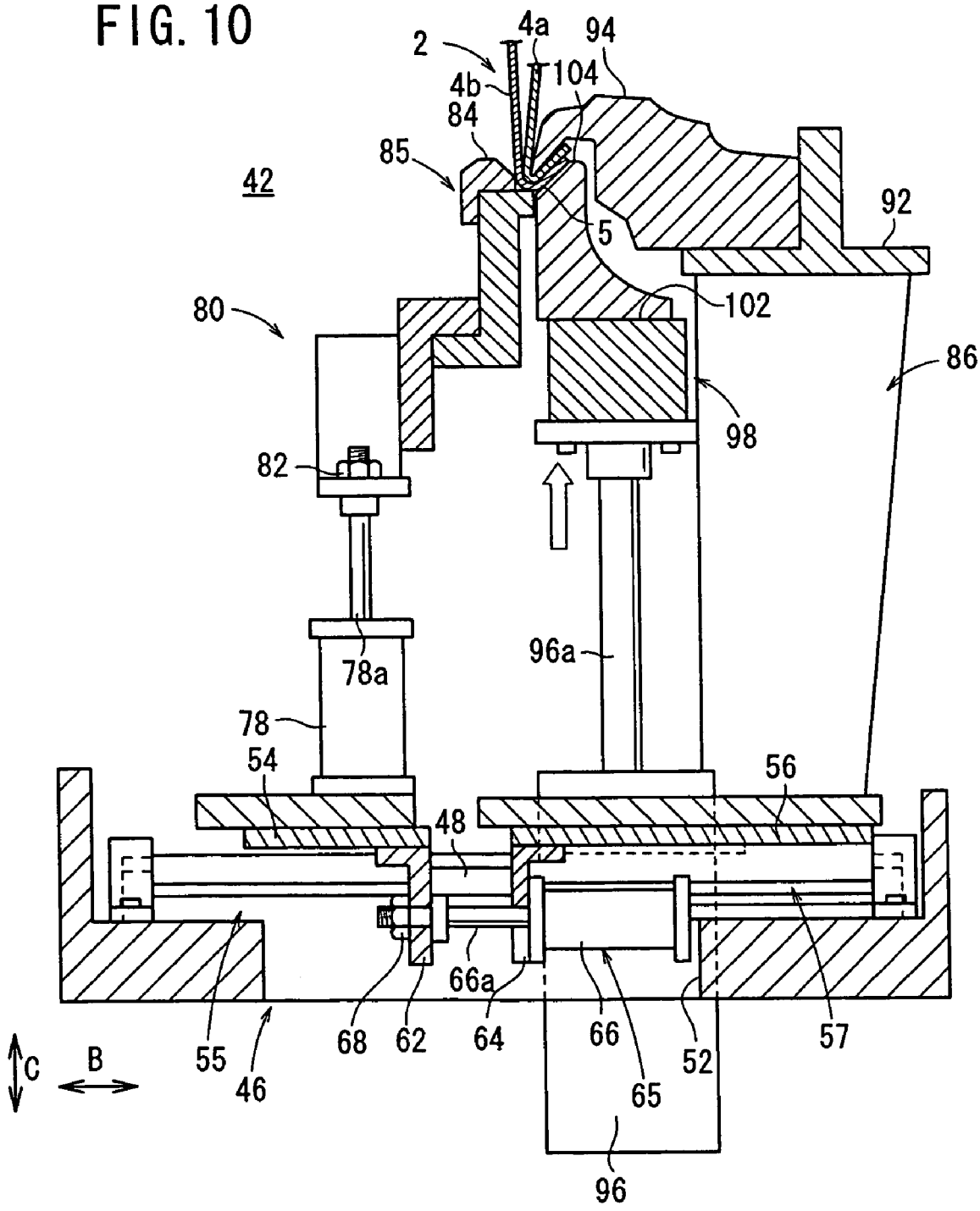
FIG. 10 is a view showing the manner in which the workpiece bending die bends a flange.

Then, when the third cylinder 96 is actuated to move the rod 96*a* upwardly, the workpiece lifting and lowering body 98 fixed to the rod 96*a* is elevated along the guide rails 90 and the guides 100. Therefore, as shown in FIG. 10, the workpiece bending die 104 mounted on the workpiece lifting and lowering body 98 engages and bends the flange 5 upwardly.

Figure 11:
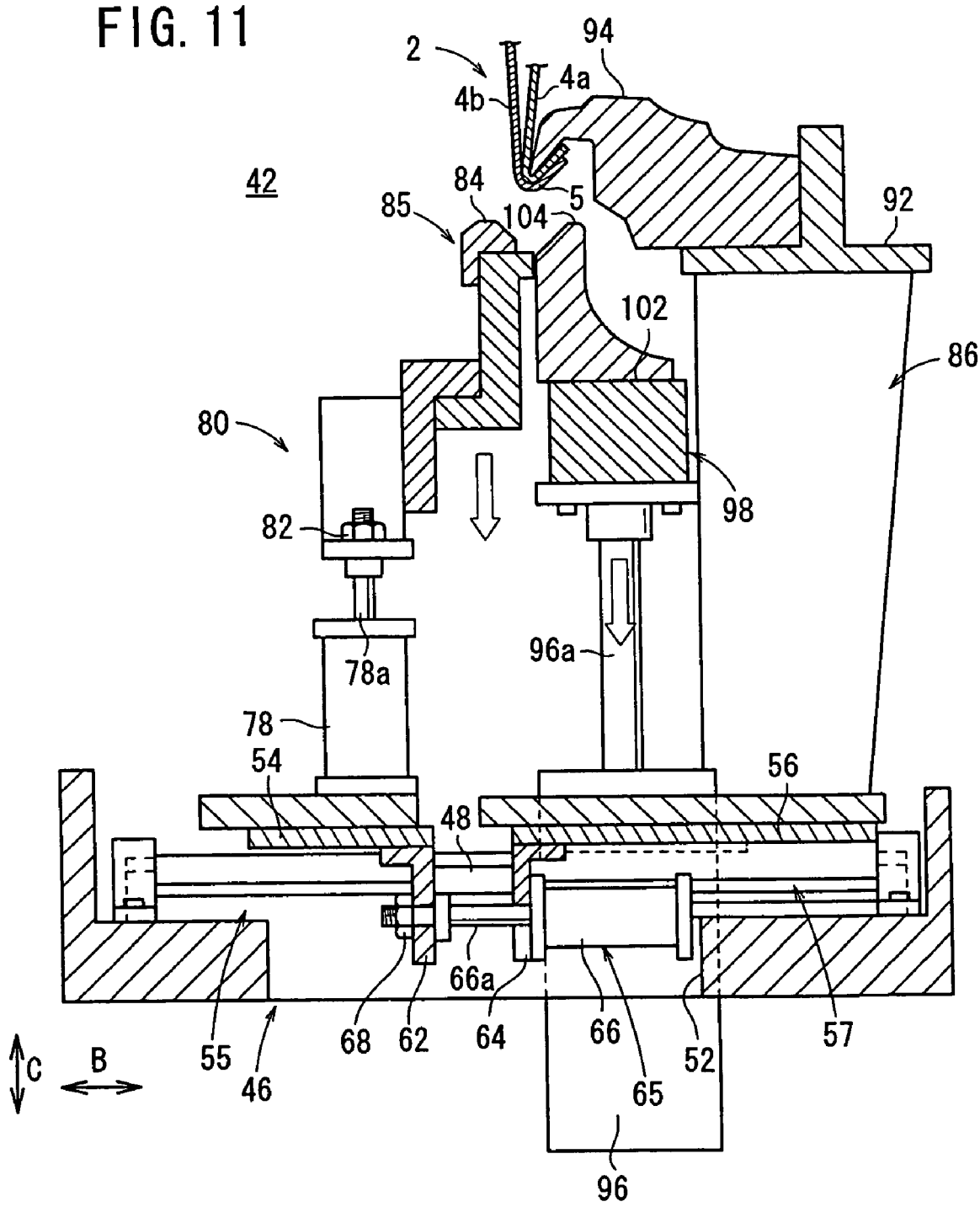
FIG. 11 is a view showing the manner in which the workpiece guide and the workpiece bending die are lowered after the flange is bent.

After the flange 5 is bent, the second and third cylinders 78, 96 are actuated to lower the workpiece guide 85 and the workpiece bending die 104 (see FIG. 11). The first cylinder 66 is actuated to project the rod 66*a* outwardly, displacing the first and second slide bases 54, 56 away from each other to displace the workpiece guide 85 and the workpiece bending die 104 away from each other. The articulated robot 34 is actuated to displace the machining mechanism 42 away from the wheel arch 2 of the vehicle body 1.

If a vehicle body 1 of different shape is to be conveyed onto the production line 22, the dedicated component of the machining mechanism 42, i.e., the workpiece bending die 104, is manually replaced, and the workpiece rest die 94 and the workpiece guide 85 are manually replaced when necessary.

Specifically, as shown in FIG. 1, the articulated robot 34 of the machining apparatus 30 moves the machining mechanism 42 from the machining station S2 to the dedicated die replacing section 112 (see the two-dot-and-dash lines in FIG. 1). The dedicated die replacing section 112 is disposed outside of the fence 110, and the operator P loosens fastening means such as bolts that fasten the workpiece bending die 104 to the clamp 102, and replaces the workpiece bending die 104 with a new workpiece bending die 104. Similarly, the operator P replaces the workpiece guide 85 and/or the workpiece rest die 94 with a new workpiece guide 85 and/or a new workpiece rest die 94.

According to the first embodiment, as described above, the first through third cylinders 66, 78, 96 of the machining mechanism 42 are mounted as general-purpose actuators on the articulated robot 34, and dedicated components that need to be replaced are limited to the workpiece bending die 104, the workpiece rest die 94, and the workpiece guide 85. Therefore, it is not necessary to provide a plurality of machining mechanisms 42 around the articulated robot 34 as in the case of when the machining mechanisms 42 are removably installed as a dedicated mechanism on the articulated robot 34.

The degree of freedom of the machining apparatus 30 is thus large, and the machining apparatus 30 can be trained and serviced for maintenance with ease. As no large pieces of equipment are disposed around the articulated robot 34, the operating efficiency of the articulated robot 34 is effectively increased.

Only the workpiece bending die 104, the workpiece rest die 94, and the workpiece guide 85 that are relatively light in weight are removable as dedicated components that need to be replaced. Consequently, the dedicated components can be replaced easily for increased operating efficiency.

In addition, a number of dedicated dies 114 can be stocked at the dedicated die replacing section 112, and a space for stocking the dedicated dies 114 is relatively small, allowing a relatively large space to be available for replacing dedicated components. The space in the production system 20 is thus effectively utilized with ease.

The machining apparatus 30, 32 are disposed on both sides of the production line 22. Therefore, the flanges 5 of the left and right wheel arches 2 of the vehicle body 1 can simultaneously be bent by the machining apparatus 30, 32, respectively. The cycle time of the production system 20 is thus made shorter than if the flanges 5 of the left and right wheel arches 2 are machined one at a time, resulting in efficient machining operation.

The machining station S2 is disposed adjacent to the welding station S1. Consequently, an articulated robot 34 for use in a welding process can be used as the machining apparatus 30. Specifically, the welding gun 28*a* and the machining mechanism 42 may only be exchanged on the wrist 38 of the articulated robot 34 by the non-illustrated automatic tool changer. The articulated robot 34 can thus easily be made versatile economically.

A flange machining method according to a second embodiment of the present invention will be described below.

Figure 12:
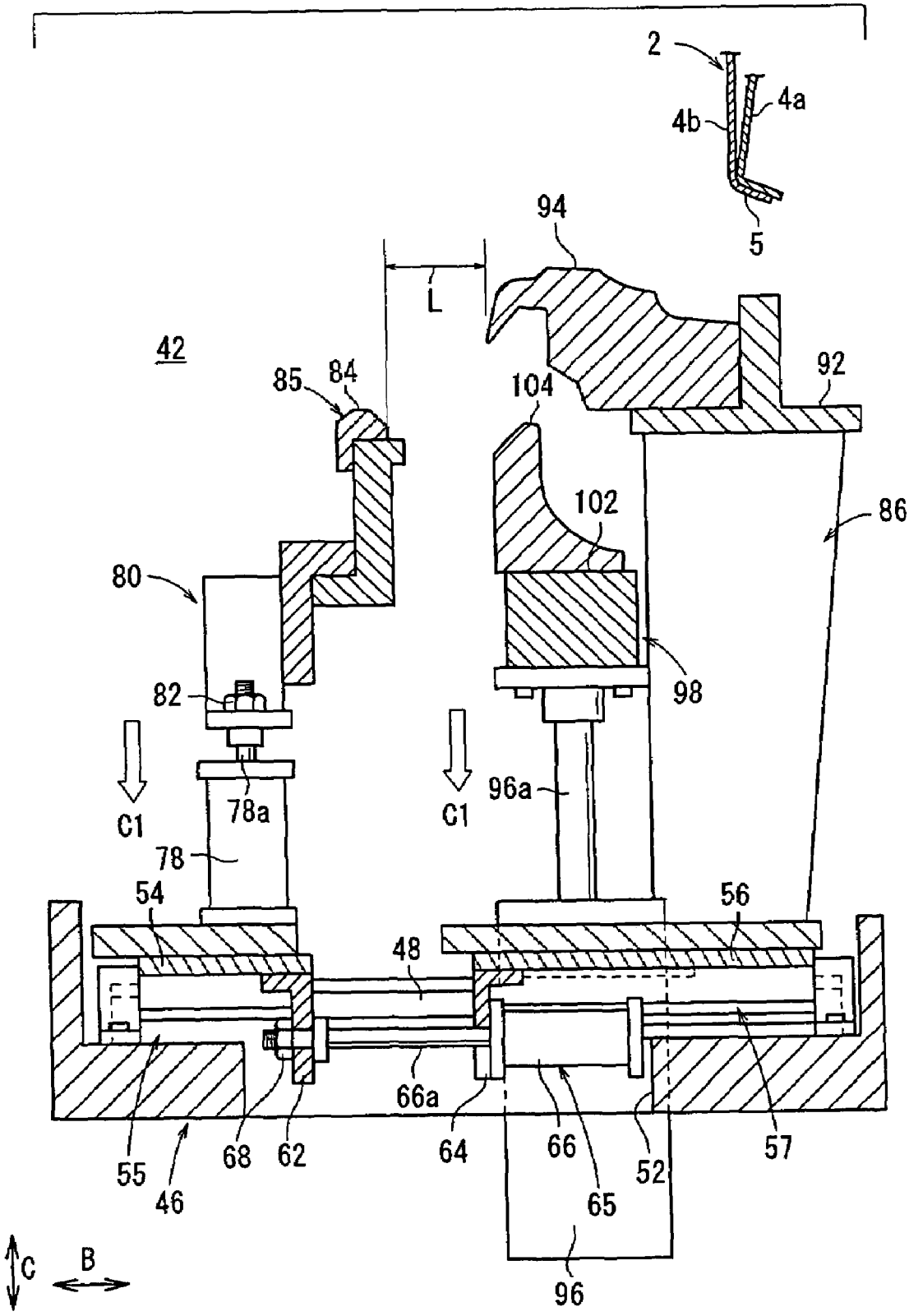
FIG. 12 is a view showing an initial state in a machining method according to a second embodiment of the present invention.

First, as shown in FIG. 12, the machining mechanism 42 is set in an initial state. Specifically, the first and second slide means 55, 57 are spaced a maximum distance away from each other in the direction indicated by the arrow B, and the workpiece guide 85 and the workpiece bending die 104 are lowered in the direction indicated by the arrow C1. The machining mechanism 42 thus configured is positioned below the wheel arch 2. At this time, the workpiece guide 85 and the workpiece rest die 94 have respective tip ends spaced from each other by a distance L.

Figure 13:
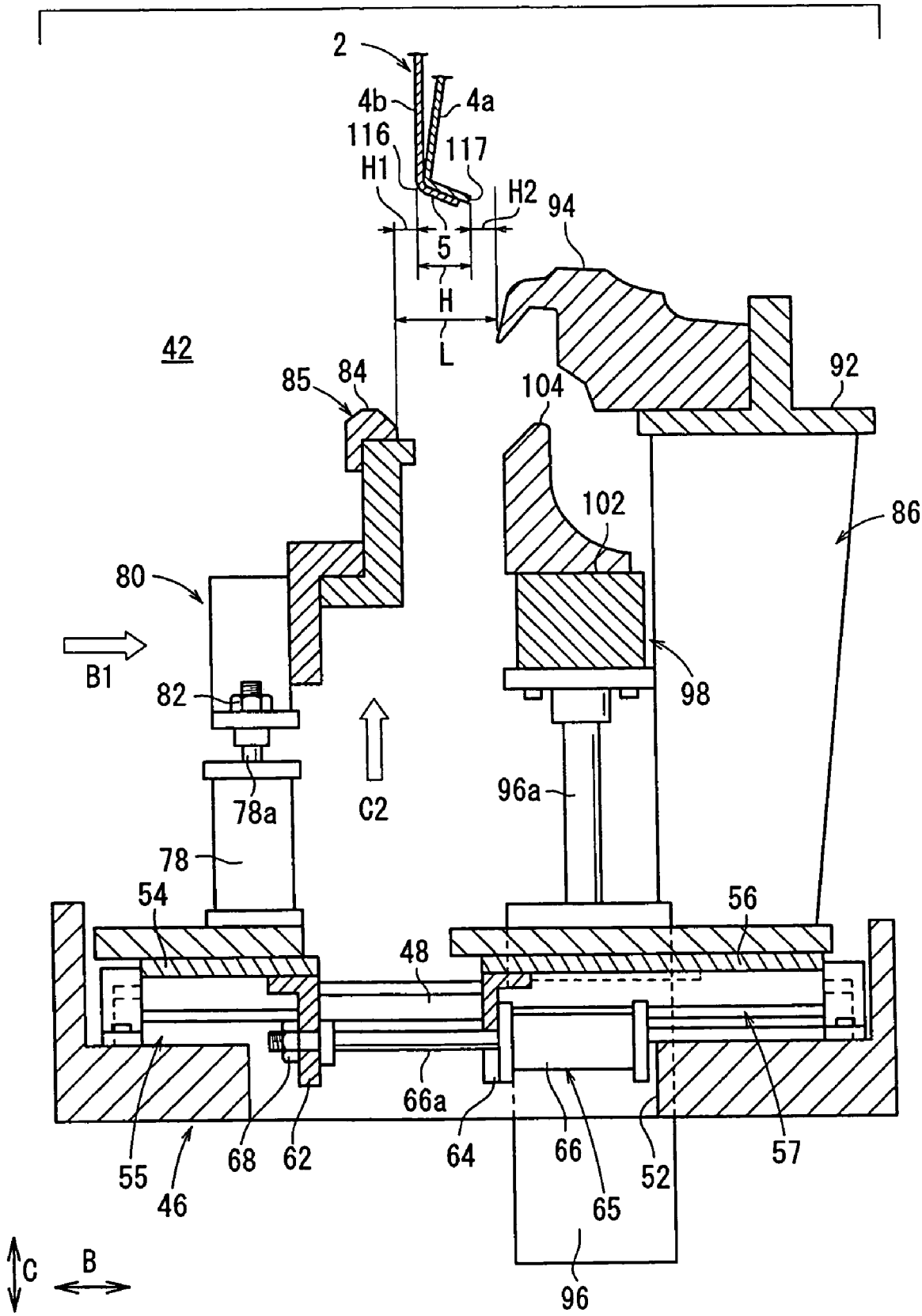
FIG. 13 is a view showing the manner in which the machining mechanism is moved below the flange.

As shown in FIG. 13, the machining mechanism 42 is moved in the direction indicated by the arrow B1 and in the direction indicated by the arrow C1 (vertically upwardly) until the machining mechanism 42 is disposed below the flange 5 of the wheel arch 2.

It is assumed that the flange 5 as projected onto a horizontal plane has a horizontal length H, the tip end of the workpiece guide 85 is spaced from an outer corner 116 of the outer panel 4*b* of the flange 5 by a clearance H1, and the tip end of the workpiece rest die 94 is spaced from a tip end 117 of the flange 5 by a clearance H2. The distance L is equal to the sum of the clearance H1, the horizontal length H, and the clearance H2.

The clearances H1, H2 are determined in view of a transverse variation of the set position of the vehicle body 1 and a transverse variation of the set position of the machining mechanism 42 due to the accuracy of the articulated robot 34.

Figure 14:
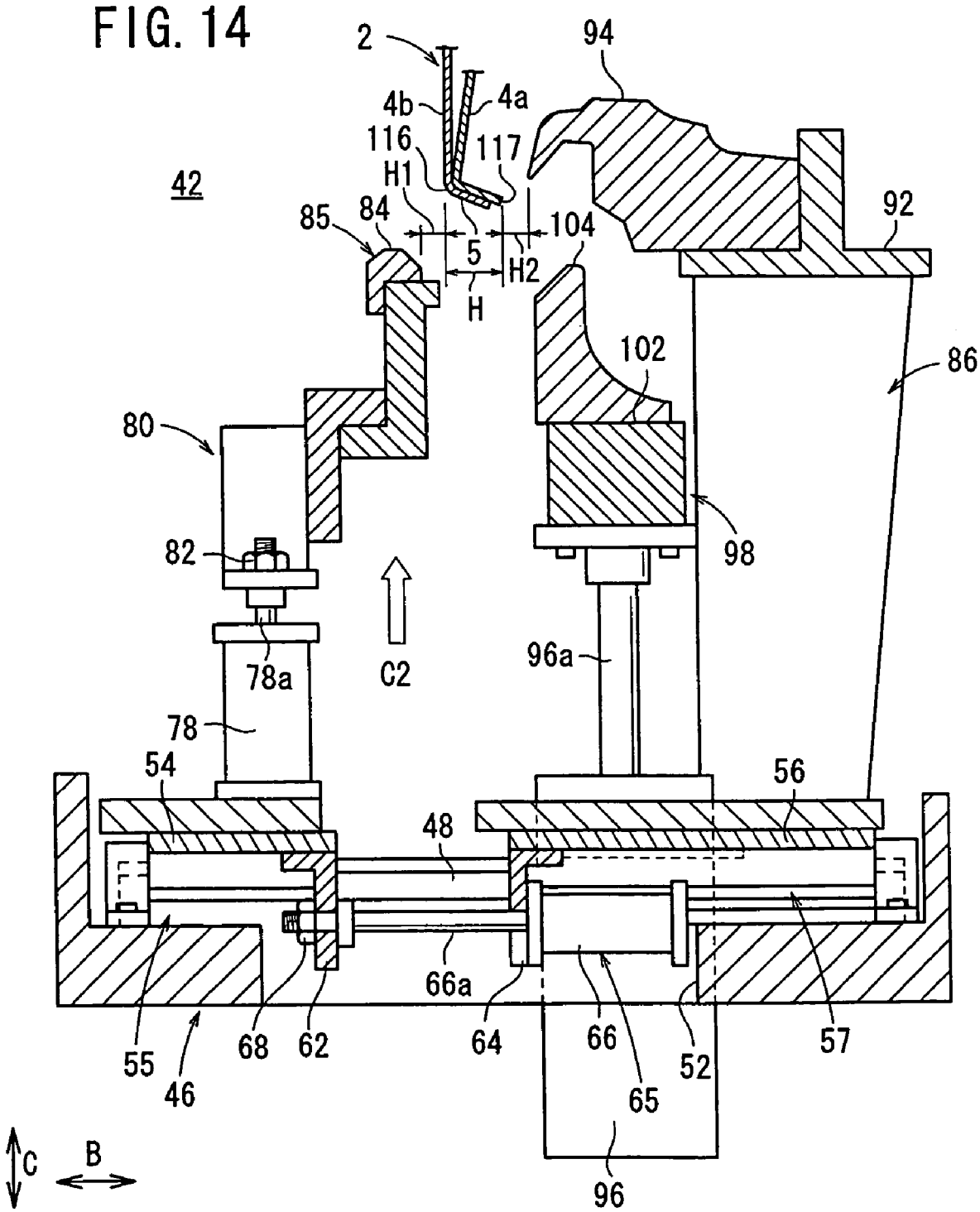
FIG. 14 is a view showing the manner in which the machining mechanism is set to a predetermined height.
Figure 15:
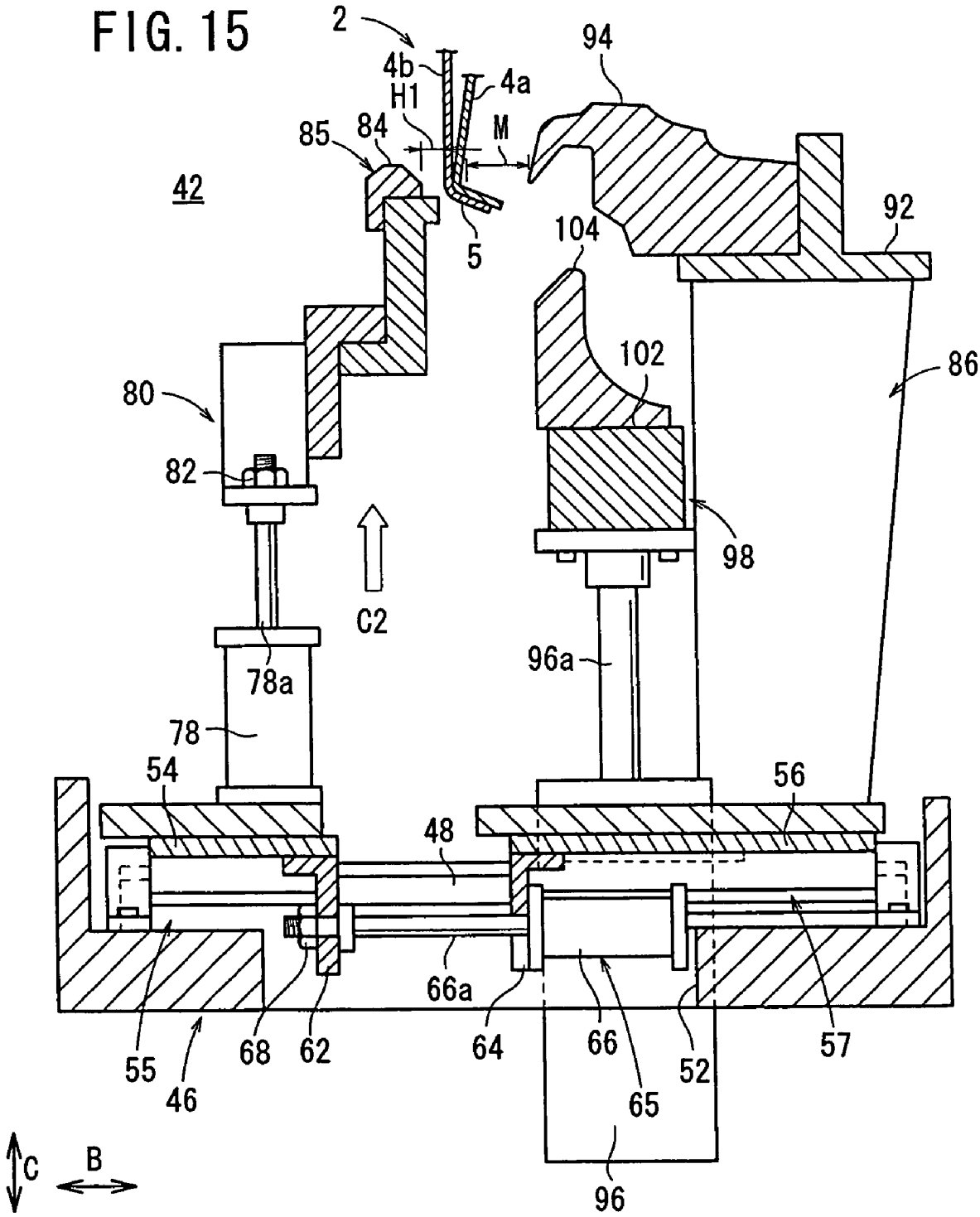
FIG. 15 is a view showing the manner in which the workpiece guide is lifted.

Then, as shown in FIG. 14, the machining mechanism 42 is lifted in the direction indicated by the arrow C2 by the articulated robot 34 to set the workpiece rest die 94 to a predetermined height. As shown in FIG. 15, the second cylinder 78 is operated to elevate the workpiece guide 85 in the direction indicated by the arrow C2 to set the workpiece guide 85 to a predetermined height.

The workpiece guide 85 is moved substantially by the clearance H1, and the workpiece rest die 94 and the workpiece bending die 104 are slid a distance M. The workpiece guide 85, the workpiece rest die 94, and the workpiece bending die 104 are now set to respective predetermined positions in the transverse direction of the vehicle body 1.

Figure 16:
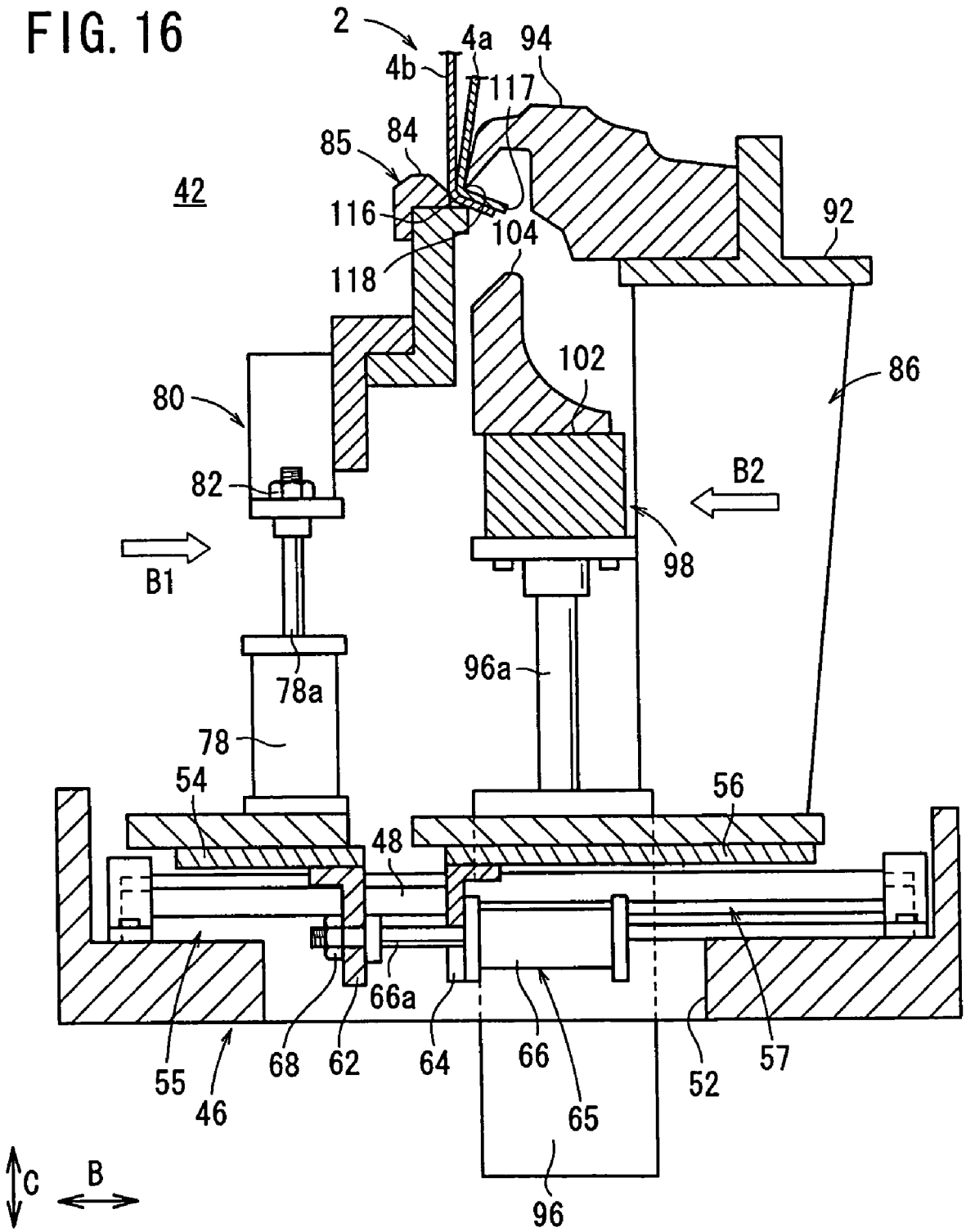
FIG. 16 is a view showing the manner in which the workpiece guide and the workpiece bending die are centered.

As shown in FIG. 16, the mutual distance changing means (the first cylinder) 65 is operated to move the first and second slide means 55, 57 respectively in the directions indicated by the arrows B1, B2, thereby setting the workpiece guide 85 and the workpiece rest die 94 to respective predetermined positions in the transverse direction of the vehicle body 1 while centering the workpiece guide 85 and the workpiece rest die 94.

Specifically, for setting the workpiece guide 85 and the workpiece rest die 94 on the wheel arch 2 of the side panel, the first and second slide means 55, 57 are spaced from each other by the mutual distance changing means 65. The clearance H1 (see FIG. 14) is provided on the outer panel (outer surface) 4*b* of the flange 5 to allow the workpiece guide 85 to be set in place, and the clearance H2 is provided from the tip end (end) 117 of the flange 5 to allow the workpiece rest die 94 to be set in place.

Then, the first and second slide means 55, 57 are brought toward each other by the mutual distance changing means 65 until the workpiece guide 85 is held against the outer corner 116 of the outer panel (outer surface) 4*b* of the flange 5 and the workpiece rest die 94 is held against an inner corner 118 of the inner panel (inner surface) 4*a* of the flange 5, whereupon the setting of the workpiece guide 85 and the workpiece rest die 94 is completed (see FIG. 16).

Figure 17:
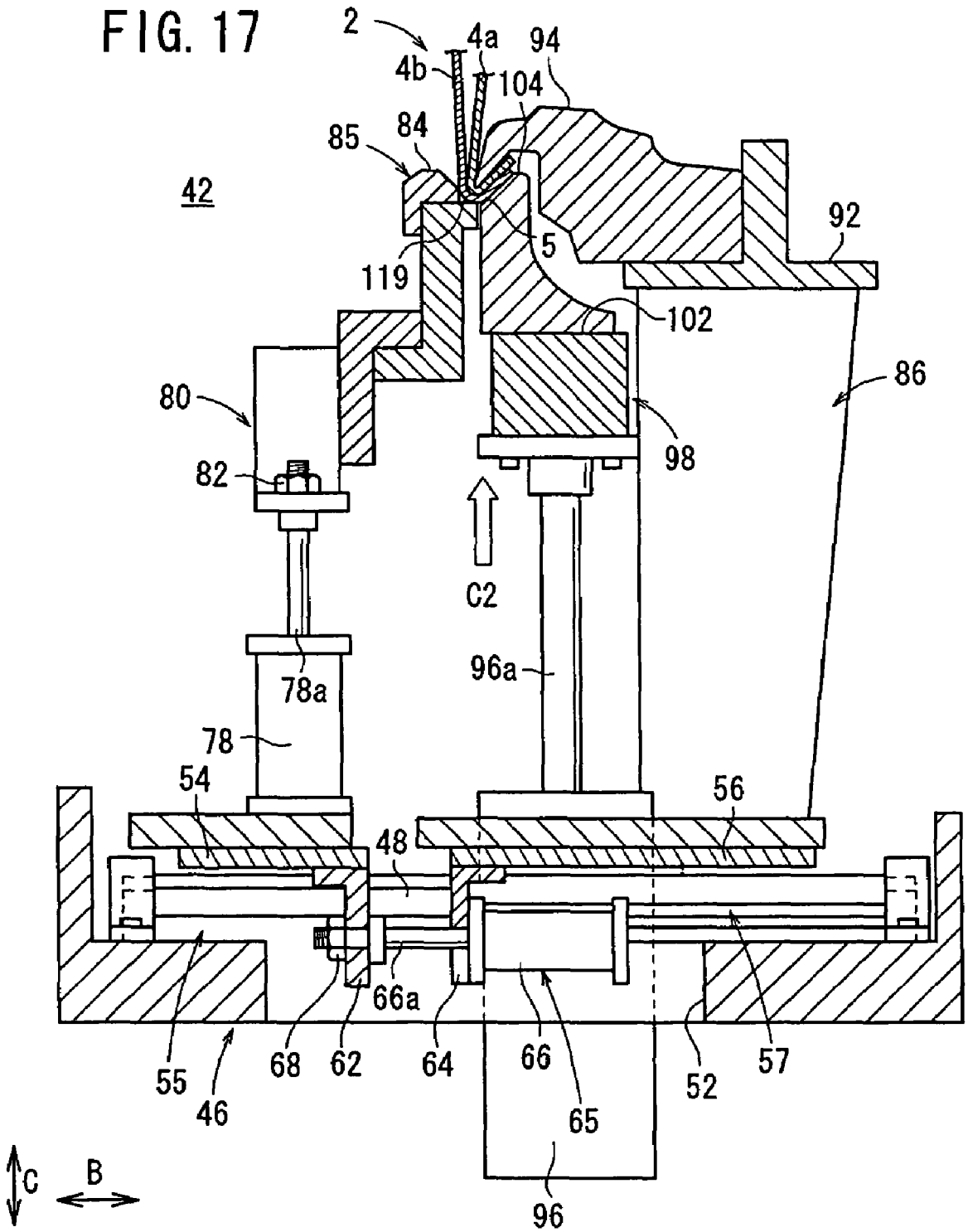
FIG. 17 is a view showing the manner in which the flange is bent.

As shown in FIG. 17, the third cylinder 96 is actuated to lift the workpiece bending die 104 in the direction indicated by the arrow C2 to bend the flange 5. The nonmetallic pad 84 provided in a workpiece abutment region 119 of the workpiece guide 85 can protect and guide the side panel. As a result, the side panel is prevented from being damaged when it is bent.

Figure 18:
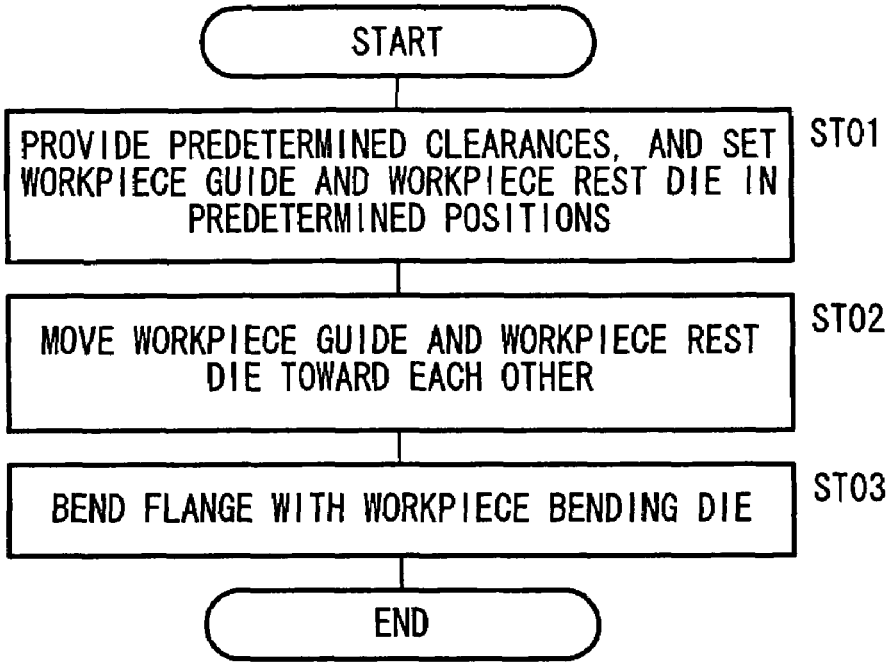
FIG. 18 is a flowchart of the second embodiment.
Figure 19:
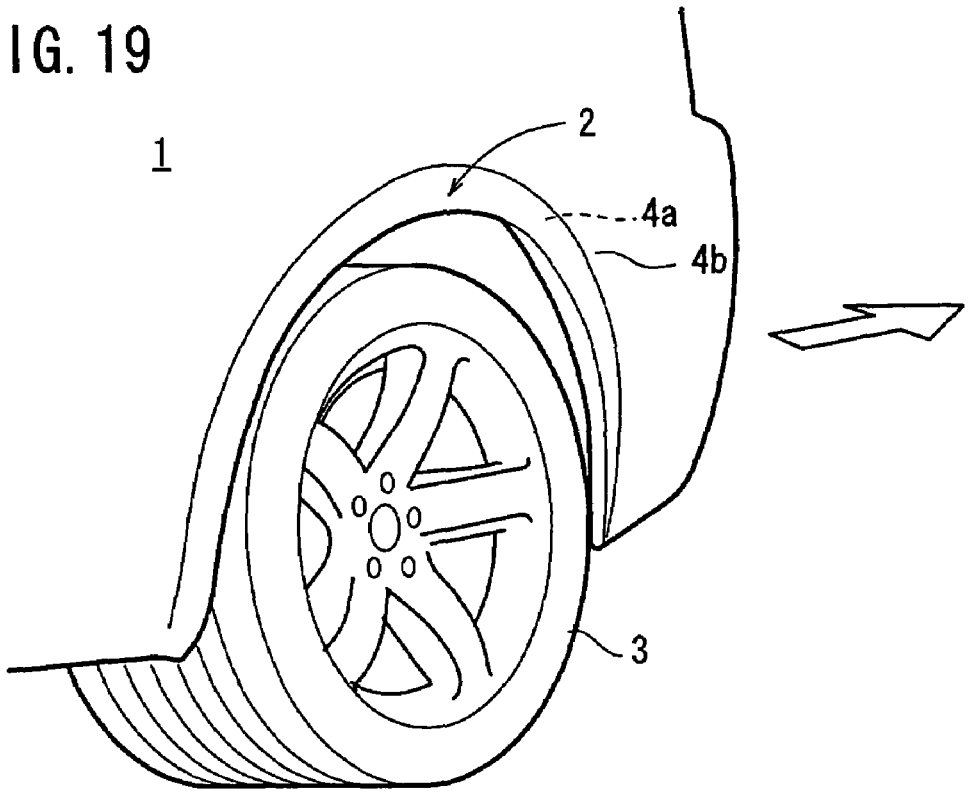
FIG. 19 is a perspective view of a wheel arch of a vehicle body.
Figure 20:
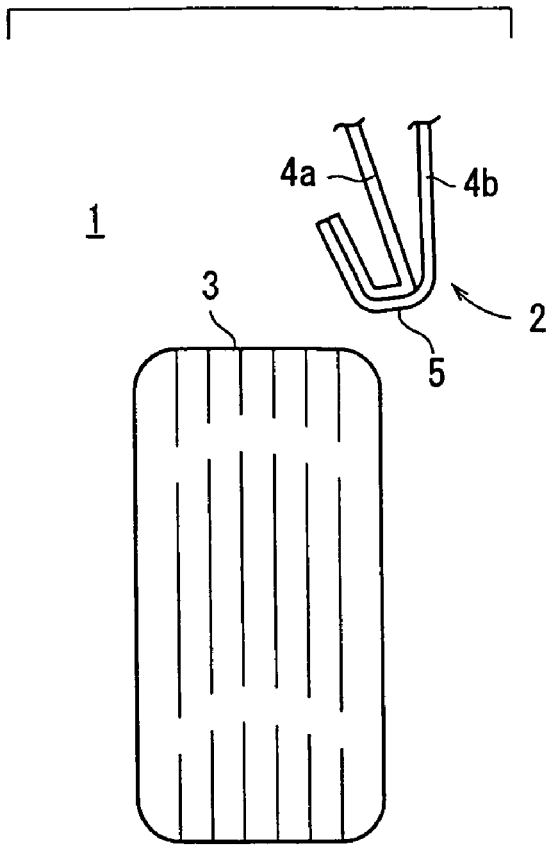
FIG. 20 is a view of a flange of the wheel arch.
Figure 21:
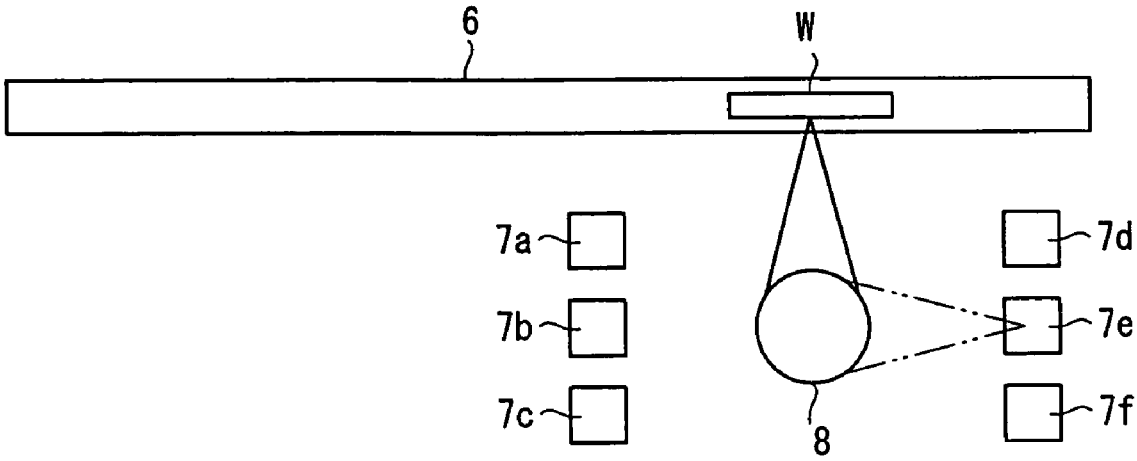
FIG. 21 is a plan view of a hem machining apparatus according to Patent Document 1.
Figure 22:
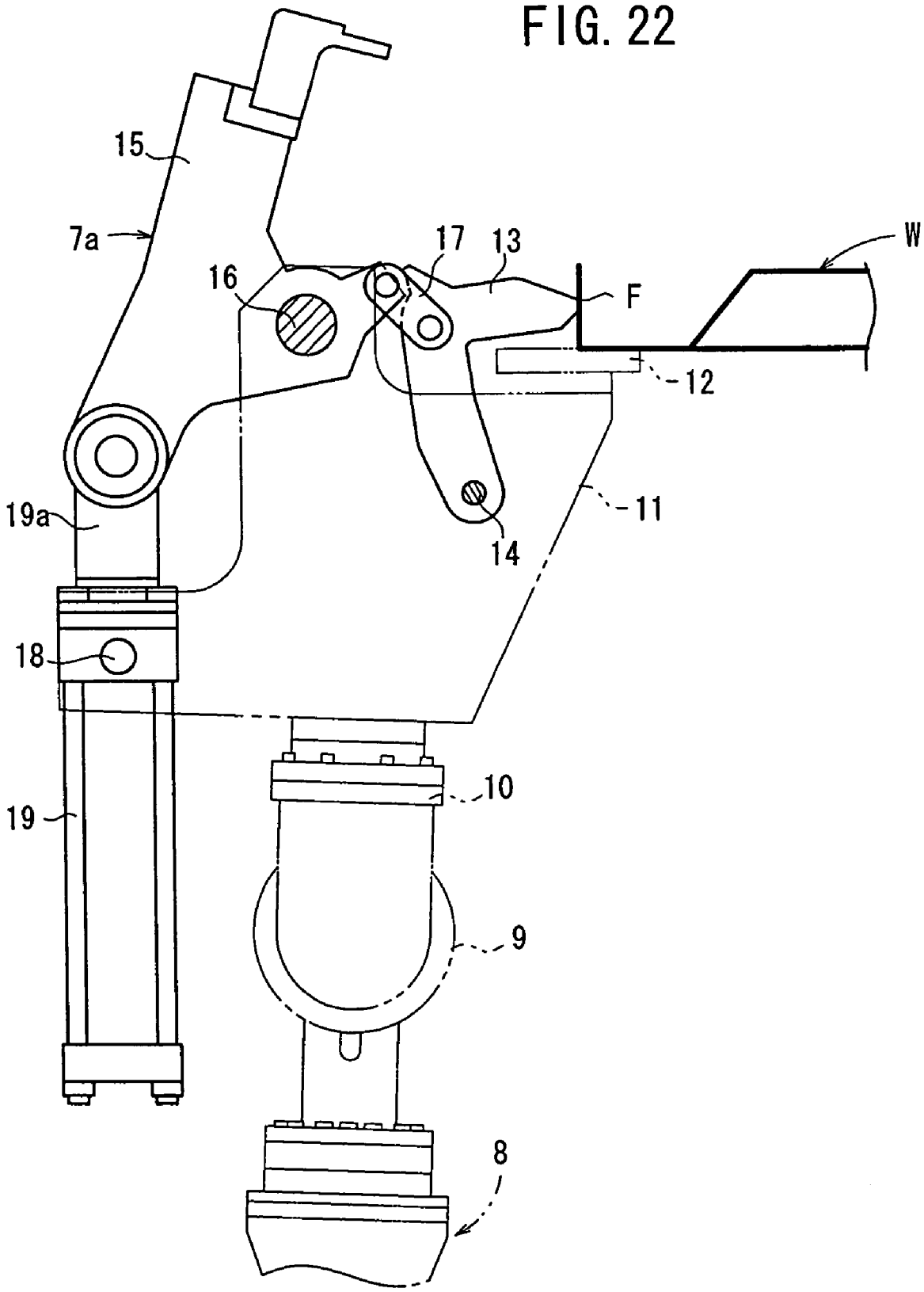
FIG. 22 is a front elevational view of a hem die of the hem machining apparatus.
Figure 23A:
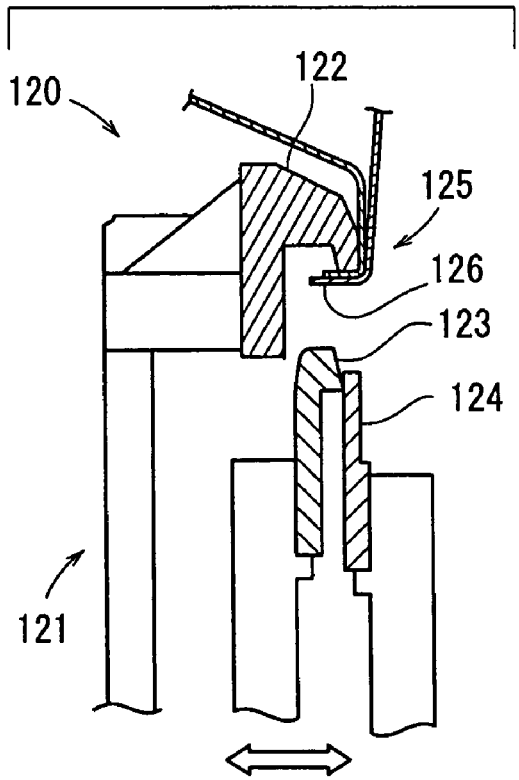
FIGS. 23A through 23D are views showing operation of Patent Document 2.
Figure 23B:
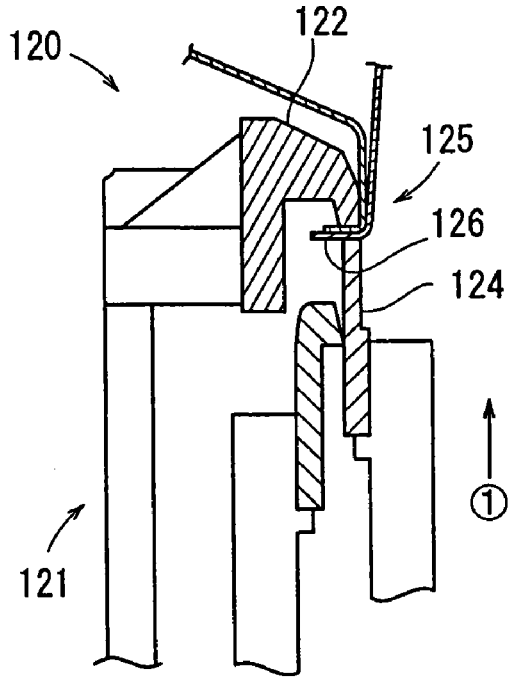
Figure 23C:
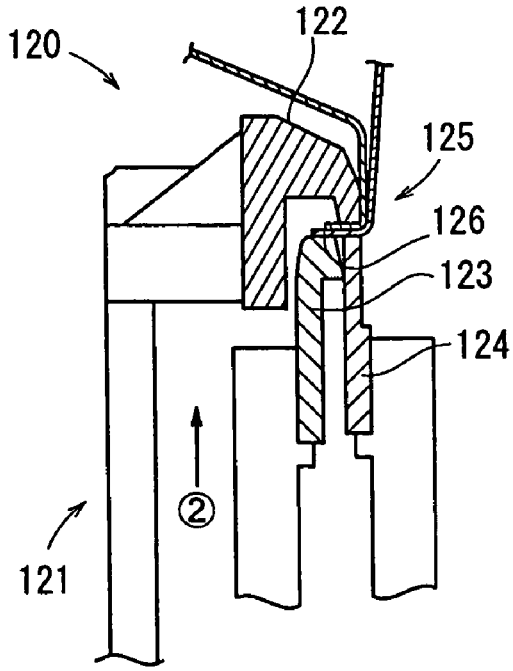
Figure 23D:
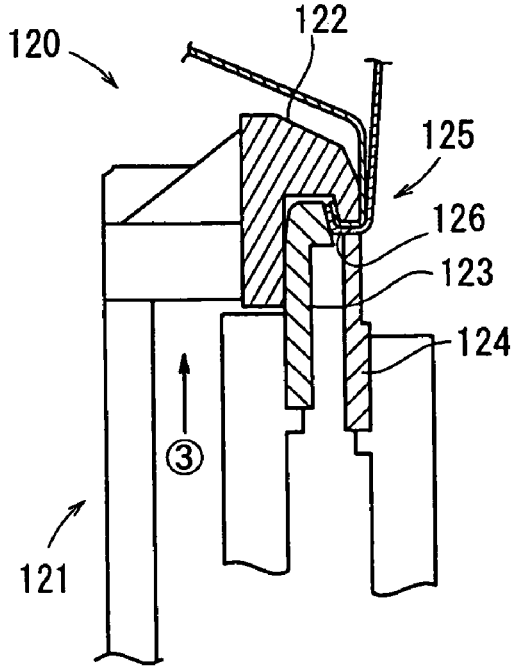

FIG. 18 is a flowchart of the machining method according to the second embodiment. ST01 through ST03 represent step numbers.

ST01:

The predetermined clearance is provided on the outer surface of the flange 5 of the wheel arch 2 to set the workpiece guide 85 as the workpiece guide means in a predetermined position, and the predetermined clearance is provided on the inner surface of the flange 5 of the wheel arch 2 to set the workpiece rest die 94 as the workpiece rest means in a predetermined position.

ST02:

The workpiece guide 85 and the workpiece rest die 94 are brought closely to each other until the workpiece guide 85 is set on the outer surface of the flange 5 and the workpiece rest die 94 is set on the inner surface of the flange 5.

ST03:

The flange 5 that is guided by the workpiece guide 85 and rests in the workpiece rest die 94 is bent by the workpiece bending die 104 as the workpiece bending means.

Specifically, the machining method has the step of providing the predetermined clearance on the outer surface of the flange 5 of the wheel arch 2 to set the workpiece guide means (the workpiece guide 85) in a predetermined position, and providing the predetermined clearance on the inner surface of the flange 5 of the wheel arch 2 to set the workpiece rest means (the workpiece rest die 94) in a predetermined position, and the step of bringing the workpiece guide means and the workpiece rest means closely to each other until the workpiece guide means is set on the outer surface of the flange 5 and the workpiece rest means is set on the inner surface of the flange 5. Therefore, a variation of the set position of the wheel arch 2 with respect to the workpiece guide means and the workpiece rest means can be absorbed. As a result, the bending of the wheel arch 2 is facilitated, and the time required to bend the wheel arch 2 is shortened.

In the embodiment, as shown in FIG. 5, the single mutual distance changing means (first cylinder) 65 is provided. However, the invention is not limited to the illustrated embodiment, but a plurality of mutual distance changing means may be disposed along the rails.

The second cylinder 78 is provided for lifting and lowering the workpiece guide 85. However, the invention is not limited to the illustrated embodiment, but a lifting and lowering means such as an electric motor, a hydraulic cylinder, or the like may be employed.

The hydraulic third cylinder 96 is employed for lifting and lowering the workpiece bending die 104. However, the invention is not limited to the illustrated embodiment, but a lifting and lowering means such as an electric motor, an air cylinder, or the like may be employed.

The first cylinder 66 as an air cylinder is employed as the mutual distance changing means 65. However, the invention is not limited to the illustrated embodiment, but a slide actuating means such as an electric motor, a hydraulic cylinder, or the like may be employed.

The nonmetallic pad 84 is provided in the workpiece abutment region 119 of the workpiece guide 85. However, the invention is not limited to the illustrated embodiment, but the nonmetallic pad 84 may be enlarged to guide a side of the outer panel 4*b*.

The invention claimed is:

1. A method of machining a flange of a wheel arch to bend said flange of said wheel arch of a vehicle body, comprising the steps of:

conveying a general-purpose actuator to a machining position for said flange with a moving mechanism while a dedicated die is being mounted on said general-purpose actuator provided on said moving mechanism; and actuating said general-purpose actuator to bring said dedicated die into abutment against said flange and to cause said dedicated die to bend said flange, wherein a machining station for bending said flange is included in a welding station for welding said vehicle body, wherein said general-purpose actuator provided on said moving mechanism is replaceable with a welding mechanism for welding said vehicle body, and wherein said welding mechanism is mounted on said moving mechanism at said welding station, whereas said general-purpose actuator is mounted on said moving mechanism at said machining station.

2. The method of machining a flange according to claim 1, wherein said wheel arch including said flange is provided on each side of said vehicle body and wherein each flange can be bent simultaneously with said moving mechanism disposed on each side of said vehicle body is actuated.

3. The method of machining a flange according to claim 1, wherein said dedicated die is selected depending on the shape of said flange and the selected dedicated die is removably mounted on said general-purpose actuator.

4. A method of machining a flange of a wheel arch to bend said flange of said wheel arch of a vehicle body, comprising the steps of:

providing a base, a first slide means slidably mounted on said base, a workpiece guide means disposed on said first slide means, a second slide means slidably mounted on said base, a workpiece rest means disposed on said second slide means, and a mutual distance changing means;

disposing workpiece guide means with a predetermined clearance provided on an outer surface of said flange of said wheel arch and disposing workpiece rest means with a predetermined clearance provided on an inner surface of said flange of said wheel arch;

moving said first slide means and said second slide means towards each other to dispose said workpiece guide means on the outer surface of said flange and to dispose said workpiece rest means on the inner surface of said flange;

bending said flange with workpiece bending means while said workpiece guide means is holding the outer surface of said flange and said workpiece rest means is holding the inner surface of said flange; and moving said first slide means and said second slide means away from each other.

5. The method of claim 4, wherein said workpiece bending means is replaceably mounted to a general-purpose actuator and wherein prior to the step of bending said flange with workpiece bending means while said workpiece guide means is holding the outer surface of said flange and said workpiece rest means is holding the inner surface of said flange, the method further comprises the step of actuating said general-purpose actuator such that said workpiece bending means cooperates with said workpiece rest means to bend said flange.

6. The method of claim 5, wherein said base is mounted on a moving mechanism disposed on each side of the vehicle body, the method further comprising the step of substantially simultaneously bending said flange on each wheel arch on each side of said vehicle body.

7. An apparatus for machining a flange of a wheel arch to bend said flange of said wheel arch of a vehicle body), comprising:

a moving mechanism for conveying a general-purpose actuator to a machining position for said flange, with said general-purpose actuator provided on said moving mechanism; and a dedicated die replaceably mounted on said general-purpose actuator, for bending said flange when said general-purpose actuator is actuated, wherein a machining station for bending said flange is included in a welding station for welding said vehicle body, wherein said general-purpose actuator provided on said moving mechanism is replaceable with a welding mechanism for welding said vehicle body, and wherein said welding mechanism is mounted on said moving mechanism at said welding station, whereas said general-purpose actuator is mounted on said moving mechanism at said machining station.

8. The apparatus for machining a flange according to claim 7, wherein said moving mechanism is disposed on each side of said vehicle body, for substantially simultaneously bending said flange of said wheel arch on each side of said vehicle body.

9. The apparatus for machining a flange according to claim 7, comprising a plurality of dedicated dies selectable depending on the shape of said flange.

10. The apparatus for machining a flange according to claim 7, comprising a dedicated die replacing section disposed outside of an operating range of said machining station, with a plurality of said dedicated dies being stockable in said dedicated die replacing section.

11. An apparatus for machining a flange of a wheel arch to bend said flange of said wheel arch of a vehicle body, comprising:

a base;

first slide means slidably mounted on said base, with workpiece guide means being disposed on said first slide means;

second slide means slidably mounted on said base, with workpiece rest means and workpiece bending means being disposed on said second slide means; and mutual distance changing means for moving said first slide means and said second slide means toward and away from each other.

12. The apparatus for machining a flange according to claim 11, wherein said workpiece guide means has a nonmetallic pad disposed in a workpiece abutment region thereof.

13. The apparatus for machining a flange according to claim 11, wherein said mutual distance changing means has a cylinder coupled to said first slide means and said second slide means.

14. The apparatus for machining a flange according to claim 11 further comprising a general-purpose actuator, wherein said workpiece bending means is replaceably mounted on said general-purpose actuator, and wherein when said general-purpose actuator is actuated said workpiece bending means cooperates with said workpiece rest means to bend said flange.

15. The apparatus for machining a flange according to claim 14 further comprising a moving mechanism disposed on each side of the vehicle body, wherein said base is mounted to each moving mechanism to thereby substantially simultaneously bend said flange on each wheel arch on each side of said vehicle body.

* * * * *